US011624143B2

(12) United States Patent
Huang et al.

(10) Patent No.: US 11,624,143 B2
(45) Date of Patent: Apr. 11, 2023

(54) WASHING FEEDING DEVICE AND WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Yuliang Jiang, Shandong (CN); Xinyu Zhao, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 153 days.

(21) Appl. No.: 16/982,675

(22) PCT Filed: Jan. 16, 2020

(86) PCT No.: PCT/CN2020/072347
§ 371 (c)(1),
(2) Date: Sep. 21, 2020

(87) PCT Pub. No.: WO2020/147763
PCT Pub. Date: Jul. 23, 2020

(65) Prior Publication Data

US 2021/0002809 A1 Jan. 7, 2021

(30) Foreign Application Priority Data

Jan. 18, 2019 (CN) ..... 201910047932.4
Jan. 18, 2019 (CN) ..... 201910047938.1
Jan. 18, 2019 (CN) ..... 201910048384.7

(51) Int. Cl.
*D06F 39/02* (2006.01)
*D06F 39/08* (2006.01)
*D06F 39/14* (2006.01)

(52) U.S. Cl.
CPC ..... *D06F 39/022* (2013.01); *D06F 39/088* (2013.01); *D06F 39/14* (2013.01); *D06F 39/028* (2013.01)

(58) Field of Classification Search
CPC ..... D06F 39/022; D06F 39/14; D06F 39/028; D06F 39/088
(Continued)

(56) References Cited

U.S. PATENT DOCUMENTS

2005/0274157 A1 12/2005 Yang
2007/0056331 A1 3/2007 Kang
(Continued)

FOREIGN PATENT DOCUMENTS

CN 1712623 A 12/2005
CN 1978743 A 6/2007
(Continued)

OTHER PUBLICATIONS

CN109183360A—machine translation (Year: 2019).*
(Continued)

*Primary Examiner* — Tinsae B Ayalew
(74) *Attorney, Agent, or Firm* — Buchanan Ingersoll & Rooney PC

(57) ABSTRACT

A washing feeding device includes a water box, and a feeding box installed in the water box; at least one feeding chamber is arranged in the feeding box. A baffle board is pivoted and installed in the feeding chamber for preventing water from flowing to a water outlet. A gap portion is formed on the baffle board, and an inlet water flow of the water box flows to the gap portion of the baffle board that is open when
(Continued)

the baffle board is pivoted, and the inlet water flow washes a bottom wall of the feeding chamber below the baffle board after passing through the baffle board from the gap portion, and opening the baffle board. Via the above arrangement, residue of washing powder at the water outlet of the feeding chamber shielded by the baffle board is prevented.

8 Claims, 12 Drawing Sheets

(58) Field of Classification Search
USPC ..... 68/17 R
See application file for complete search history.

(56) References Cited

U.S. PATENT DOCUMENTS

| | | | | |
|---|---|---|---|---|
| 2007/0079637 | A1 | 4/2007 | Song | |
| 2007/0131000 | A1 | 6/2007 | Jeong | |
| 2011/0277515 | A1* | 11/2011 | Doh | D06F 39/08 68/17 R |
| 2012/0060568 | A1 | 3/2012 | Buso et al. | |
| 2019/0345661 | A1 | 11/2019 | Ko et al. | |

FOREIGN PATENT DOCUMENTS

| | | | | | |
|---|---|---|---|---|---|
| CN | 101177896 | A | | 5/2008 | |
| CN | 201793951 | U | | 4/2011 | |
| CN | 102449228 | A | | 5/2012 | |
| CN | 102776752 | A | | 11/2012 | |
| CN | 204199055 | U | | 3/2015 | |
| CN | 104711821 | A | | 6/2015 | |
| CN | 204551070 | U | | 8/2015 | |
| CN | 105483979 | A | | 4/2016 | |
| CN | 108252034 | A | | 7/2018 | |
| CN | 208266482 | U | | 12/2018 | |
| CN | 109183360 | A | | 1/2019 | |
| CN | 109898286 | A | | 6/2019 | |
| GB | 2187764 | A | * | 9/1987 | D06F 39/02 |
| JP | 2011019679 | A | | 2/2011 | |
| KR | 20050036535 | A | | 4/2005 | |
| KR | 20080087363 | A | | 10/2008 | |
| WO | 2018128262 | A1 | | 7/2018 | |

OTHER PUBLICATIONS

CN104711821A—machine translation (Year: 2015).*
International Search Report (with English Translation) and Written Opinion issued in corresponding International Patent Application No. PCT/CN2020/072347, 11 pages (dated Apr. 16, 2020).
European Search Opinion dated Nov. 16, 2020, issued in corresponding European Application No. 20720327.4. (3 pages).
Office Action dated Oct. 19, 2021, in corresponding Chinese Patent Application No. 201910047938.1 and English translation of the Office Action. (12 pages).
Office Action dated Oct. 26, 2021, in corresponding Chinese Patent Application No. 201910047932.4 and English translation of the Office Action. (12 pages).

* cited by examiner

WASHING FEEDING DEVICE AND WASHING MACHINE

TECHNICAL FIELD

The present disclosure belongs to the field of washing devices and particularly relates to a washing feeding device applied to a washing machine.

BACKGROUND

A washing feeding device of a washing machine is installed on a machine body.

A feeding chamber or a liquid storage chamber is arranged on the washing feeding device to make a user add a washing additive to the feeding chamber or the liquid storage chamber manually, and then inlet water of the washing machine is used to flush the added washing additive to a water holding container of the washing machine. The current washing additive generally has two forms: one is washing powder in a solid shape and the other is a liquid detergent, a disinfectant, a softener and the like.

Washing powder in a powder shape is generally placed into a chamber directly. After washing is started, the inlet water can be used to directly flush the washing powder away. However, only when a liquid washing additive is fed in a closed space, can it ensure that the additive is firstly diluted by flowing water in a washing process and then the diluted additive is washed away.

At present, the washing feeding device, in order to respectively feed different forms of washing additives, generally adopts the following manner: the washing powder in a powder shape and the liquid washing additives are respectively fed by different feeding chambers, requiring that corresponding structures are installed accordingly in the corresponding feeding chambers.

Therefore, how to set an adjusting structure in one feeding chamber to make the feeding chamber simultaneously feed the solid and liquid washing additives has become a hot research and development issue. Meanwhile, how to ensure reduction of residue of the washing additives in the feeding chambers after the adjusting structures are added has also become a technical problem that needs to be solved urgently.

In view of this, the present disclosure is proposed.

SUMMARY

The technical problem to be solved in the present disclosure is to overcome defects of the prior art and a washing feeding device is provided for realizing a purpose of adaptively feeding different forms of washing additives, such as liquid washing additives and solid washing additives, respectively. Another objective of the present disclosure is to provide a washing feeding device to realize a purpose of reducing residue of the washing additives in chambers.

In order to solve the above technical problem, the basic concept of the technical solution adopted in the present disclosure is as follows:

A washing feeding device comprises a water box and a feeding box installed in the water box. At least one feeding chamber is arranged in the feeding box. A baffle board is pivoted and installed in the feeding chamber for preventing water from flowing to a water outlet. A gap portion is formed on the baffle board, and an inlet water flow of the water box flows to the gap portion of the baffle board being open when the baffle board is pivoted, and the inlet water flow washes a bottom wall of the feeding chamber below the baffle board after passing through the baffle board from the gap portion, and opening the baffle board.

Further, an auxiliary baffle board is arranged in the feeding chamber, and the gap portion is blocked by the auxiliary baffle board when the baffle board is reset, so that the baffle board and the auxiliary baffle board jointly separate the feeding chamber into two mutually independent portions.

Further, the gap portion is arranged on a position, close to a side wall of the feeding chamber, of the baffle board, and so that water flow washing the feeding chamber flows from a corresponding side of the feeding chamber and passes through the gap portion to wash the bottom wall of the feeding chamber below the baffle board. Preferably, the water outlet of the feeding chamber is arranged in a side opposite to the gap portion on the baffle board.

Further, the auxiliary baffle board is vertically arranged in the feeding chamber, at least a portion of a periphery of the auxiliary baffle board protrudes out of a periphery of the gap portion when the baffle board is reset, and the baffle board is limited to a vertical closing position via the auxiliary baffle board when the baffle board is reset.

Further, a siphon is arranged on the baffle board for communicating two sides of the baffle board, so that at an upstream side of the baffle board, a detergent fed to the water box from the feeding chamber and inlet water are blocked jointly by the baffle board and the auxiliary baffle board to accumulated until reaching a liquid level for triggering a siphonic effect, and flow to a downstream side of the baffle board through the siphon, and flow out from the feeding chamber through the water outlet.

Further, the siphon is a flow channel with inverted U-shape, two ends of the flow channel are respectively located at two sides of the baffle board, and a height of the flow channel at a corner is not lower than a height of a top end of the baffle board.

Further, one end of the flow channel with inverted U-shape located at the upstream side of the baffle board is a water inlet end and the other end of the flow channel with inverted U-shape located at the downstream side of the baffle board is a water outlet end, an interval is formed between the water inlet end and the bottom wall of the feeding chamber for introducing the detergent and water to flow into the flow channel, and an interval is formed between the water outlet end and the bottom wall of the feeding chamber for introducing the detergent and water to flow out of the flow channel.

Further, the water inlet end of the flow channel with inverted U-shape is higher than the water outlet end of the flow channel with inverted U-shape. Preferably, the bottom wall of the feeding chamber is arranged obliquely downward gradually toward the water outlet along a direction vertical to the baffle board.

Further, the siphon comprises a main body which is fixedly installed or integrated onto the baffle board, and the main body is a tubular shape extending vertically and being hollow inside. A hollow portion of the main body is separated by the baffle board into two mutually independent portions: a water inlet flow channel and a water outlet flow channel. A top of the main body is buckled with an upper cover in a sealing manner, a lower side of the upper cover is provided with a groove sinking inward and tops of the water inlet flow channel and the water outlet flow channel is communicated by the groove.

Further, two ends of a top of the baffle board are respectively provided with rotary shafts which protrude outwards.

The two rotary shafts are arranged coaxially and penetrate respectively into side walls of the feeding chamber at a corresponding side, and the baffle board is installed onto the feeding box in an axial rotation manner. The baffle board is in vertical position for blocking the detergent while the detergent is fed into the water box from the feeding box, and the baffle board is in horizontal or oblique position for flowing the washing powder to the water outlet while the washing powder is fed into the water box from the feeding box.

The technical problem to be solved in the present disclosure is to overcome defects of the prior art and a washing feeding device is for realizing a purpose of adaptively feeding different forms of washing additives, such as liquid washing additives and solid washing additives respectively. Another objective of the present disclosure is to provide a washing feeding device to realize a purpose of reducing residue of the washing additives in chambers. Further, another objective of the present disclosure is to provide a washing feeding device to prevent a feeding box from moving at too large amplitude, so as to further avoid triggering siphoning by mistake.

In order to solve the above technical problem, the basic concept of the technical solution adopted in the present disclosure is as follows:

A washing feeding device, comprising a water box and a feeding box is installed in the water box. At least one feeding chamber is arranged in the feeding box, a siphon column is installed in the feeding chamber. A center flow channel and a peripheral flow channel are arranged in the siphon column, the center flow channel and the peripheral flow channel are mutually independent and vertically extend. Top ends of the center flow channel and the peripheral flow channel are sealed via a siphon cover and are communicated with each other. A bottom end of the center flow channel is communicated with the water box, and a bottom end of the peripheral flow channel is communicated with the feeding chamber. A blocking rib is arranged around a periphery of the siphon column in the feeding chamber, so that a detergent and inlet water in the feeding chamber flow around the blocking rib and into a space between the blocking rib and the siphon column after through the blocking rib.

Further, a lower end of the blocking rib is connected to a bottom wall of the feeding chamber in a sealing manner to prevent the detergent in the feeding chamber from directly flowing to an inlet of the siphon column in a bottom of the siphon column. Preferably, a top of the blocking rib is higher than a maximum liquid level of the feeding chamber.

Further, the blocking rib at least covers a side, facing a side of the feeding box being pulled out, of the siphon column.

Further, the blocking rib is a circle of arc rib arranged around the periphery of the siphon column. A gap for allowing the detergent to pass through is formed in the blocking rib. Preferably, the gap in the blocking rib, relative to the siphon column, is formed in an opposite side of a pull-out direction of the feeding box.

Further, the siphon column is arranged in the feeding chamber close to a rear side, two ends of the blocking rib with arc-shape respectively extend to a position close to a rear side wall of the feeding chamber. Interval gaps are formed between two ends of the blocking rib with arc-shape and the rear side wall of the feeding chamber respectively, and the interval gaps are used for allowing the detergent to pass through.

Further, the blocking rib is covered by the periphery of the siphon cover, making the siphon cover and the blocking rib overlap on a vertical projection face. A gap is formed between a lower side of the siphon cover and a top end of the blocking rib.

Further, a shielding rib is arranged on a side, facing the side of the feeding box being pulled out, of the siphon cover, the shielding rib extends downward in a protruding manner. The shielding rib and the blocking rib are arranged with an interval, the shielding rib, relative to the blocking rib, is arranged closely to the side of the feeding box being pulled out. A lower end of the shielding rib is arranged lower than a top end of the blocking rib.

Further, a middle of the siphon cover is provided with a first sleeve extending vertically downward, a second sleeve extending vertically upward is arranged on the bottom wall of the feeding chamber, and the second sleeve is arranged inside the first sleeve. An interval gap is formed between the first sleeve and the bottom wall of the feeding chamber, and an interval gap is formed between a top of the second sleeve and the siphon cover. The peripheral flow channel is formed by a space between the first sleeve and the second sleeve, the center flow channel is formed by an inside of the second sleeve, and a bottom of the second sleeve is communicated with the water box.

Further, the bottom of the feeding chamber is provided with a groove sinking downward, the siphon column is arranged inside the groove, and the blocking rib is arranged at a peripheral edge of the groove.

Further, a plurality of feeding chambers are arranged in the feeding box, and the siphon column and the blocking rib arranged around the periphery of the siphon column are arranged inside each of feeding chambers, so that the detergent in the feeding box flows around the blocking rib and into a space between the siphon column and the blocking rib after passing through the blocking rib.

The technical problem to be solved in the present disclosure is to overcome defects of the prior art and a washing feeding device is provided, aiming to perform two-side-layer protection for a water inlet flow channel in the cover plate, avoid water leakage of the cover plate and improve security of a washing machine.

In order to solve the above technical problem, the basic concept of the technical solution adopted in the present disclosure is as follows:

A washing feeding device, comprising a water box and a feeding box installed in the water box. A top of the water box is arranged a cover plate, a water inlet flow channel for injecting water into the feeding box is arranged in a hollow chamber inside the cover plate. A periphery of the water inlet flow channel is provided with an airtight chamber extending along a periphery of the cover plate. The airtight chamber separates the water inlet flow channel from an exterior of the cover plate.

Further, the cover plate comprises a lower cover and an upper cover buckled with each other, a groove is provided on a periphery of the lower cover, a groove is provided on a periphery of the upper cover, an opening of the groove of the lower cover and an opening of the groove of the upper cover are arranged oppositely. The groove of the lower cover and the groove of the upper cover are matched with each other to close the opening of the groove of the lower cover and the opening of the groove of the upper cover and form the airtight chamber.

Further, the cover plate comprises a lower cover and an upper cover buckled with each other, a groove with an opening is provided on a periphery of the lower cover. One side, buckled with the lower cover, of the upper cover is a plane, and a side wall, toward the upper cover, of the groove is attached onto a surface of the upper cover to close the opening of the groove and form the airtight chamber.

Further, an inner rib plate and an outer rib plate are arranged in interval on the lower cover and/or the upper cover. The groove is formed between the inner rib plate and the outer rib plate. The outer rib plate extends along the periphery of the outer rib plate and/or the periphery of the upper cover, and the inner rib plate extends along the periphery of the water inlet flow channel.

Further, an inner rib plates and an outer rib plate are arranged in interval on the lower cover and/or the upper cover. The groove is formed by a space between the inner rib plate and the outer rib plate. The outer rib plate extends along the periphery of the lower cover and/or periphery of the upper cover, the inner rib plate and the outer rib are arranged in parallel.

Further, a shape of the outer rib plate of the lower cover is same with a shape of the outer rib plate of the upper cover, a shape of the inner rib plate of the lower cover is same with a shape of the inner rib plate of the upper cover. The outer rib plate of the lower cover and the outer rib plate of the upper cover are correspondingly welded in a sealing manner, and the inner rib plate of the lower cover and the inner rib plate of the upper cover are correspondingly welded in a sealing manner.

Further, the lower cover is detachably installed on the top of the water box; at least one through hole is formed in the groove of the lower cover. One end of the through hole is communicated with the airtight chamber and the other end of the through hole is communicated with the water box.

Further, at least one water inlet flow channel for guiding water flow is arranged on the lower cover and/or the upper cover of the cover plate. The at least one water inlet flow channel is separated from the exterior via the inner rib plate and the outer rib plate, adjacent water inlet flow channels are separated by a diversion rib plate with two layers sealed at an interval. A height of the diversion rib plate is equal to a height of the inner rib plate or the outer rib plate protruding out of the lower cover and/or the upper cover to the upper cover and/or the lower cover.

Further, a water inlet pipe is arranged on the lower cover, and passes through the airtight chamber to be communicated with a water inlet of the water inlet flow channel, and a water outlet hole is formed in the water inlet flow channel, and communicated with the feeding box.

Further, the present disclosure also relates to a washing machine provided with the above washing feeding device.

After the above technical solution is adopted, the present disclosure has the following advantageous effects compared with the prior art.

1. By the above arrangement, the detergent added into the feeding chamber by the user can be blocked by the baffle board, thereby preventing the detergent which is not diluted by flowing water from directly flowing into the water box, further realizing purposes of improving detergent diluting efficiency and enlarging a detergent distribution range.

2. By the above arrangement, the inlet water of the water box flows through the gap portion of the baffle board to wash the bottom wall of the feeding chamber blocked below the baffle board, thereby avoiding residue of the washing powder at the water outlet of the feeding chamber and realizing a purpose of preventing residue of the washing powder at the water outlet of the feeding chamber shielded by the baffle board.

3. By the arrangement of the baffle board capable of overturning, a corresponding using state is adjusted when the feeding device respectively feeds the liquid and solid washing additives, thereby ensuring smooth feeding of the additives.

4. Via a downpipe arranged vertically on the feeding box of the feeding device in a penetrating manner, residual water on a top surface of the feeding box flows to the bottom of the water box below the feeding box through the downpipe, thereby avoiding residue of water on the top surface of the feeding box, and further preventing the residual water from leaking to the outside of the washing machine when the user pulls the feeding box out.

5. By arranging the blocking rib at the periphery of the siphon, the siphon and the feeding chamber are separated, to prevent the siphon from triggering siphoning by mistake due to increase of the liquid level at the siphon caused by surging liquid in the feeding chamber in a process of pulling the feeding box, thereby realizing a purpose of preventing "surging" of the siphon to avoid triggering siphoning by mistake.

6. By arranging a hollow portion located at the periphery of the siphon on the cover plate of the feeding chamber, the inlet water for washing on the top surface of the feeding box flows into the feeding chamber along the hollow portion, thereby avoiding residue of the inlet water on the top surface of the feeding box. Meanwhile, water on the top surface of the feeding box flows into the feeding chamber along the hollow portion close to the siphon, water flows downward along an outer wall of the siphon to wash an outer wall surface of the siphon, thereby avoiding residue of the detergent on the outer wall of the siphon and generation of water stain.

7. By the above arrangement in the present disclosure, the inner rib plate is arranged at the periphery of the water inlet flow channel, the outer rib plate is arranged at the periphery of the cover plate, the inner rib plate and the outer rib plate are arranged in an interlaced manner to form the airtight chamber, thereby forming double-layer protection on the water inlet flow channel, improving security and reliability and effectively avoiding water leakage of the feeding device.

8. The through hole formed in the airtight chamber can balance air pressure inside and outside the airtight chamber in a process of welding the upper cover and the lower cover, thereby reducing the risk of crack of the welding position of the upper cover and the lower cover. Pressure test is performed on the airtight chamber via the through hole, to detect whether there is a crack at the welding position. When a crack appears at the welding position of the inner rib plate, the through hole can guide water in the airtight chamber to the feeding box, to avoid water leakage of the cover plate.

Meanwhile, the technical scheme of the present disclosure is simple in structure, significant in effect, and suitable for promotion and use.

Accompanying drawings will be incorporated below to further describe specific embodiments of the present disclosure in details.

BRIEF DESCRIPTION OF THE DRAWINGS

The accompanying drawings, as a part of the present disclosure, are used for further understanding of the present disclosure. Illustrative embodiments of the present disclosure and description thereof are used for interpreting the present disclosure, but do not constitute undue limitation to the present disclosure. Obviously, the accompanying drawings described below are merely some embodiments. Under the precondition of not paying any creative labor, those skilled in the art can further obtain other accompanying drawings according to these accompanying drawings. In the accompanying drawings.

DESCRIPTION OF MAIN COMPONENTS IN THE DRAWINGS

Figure 1:
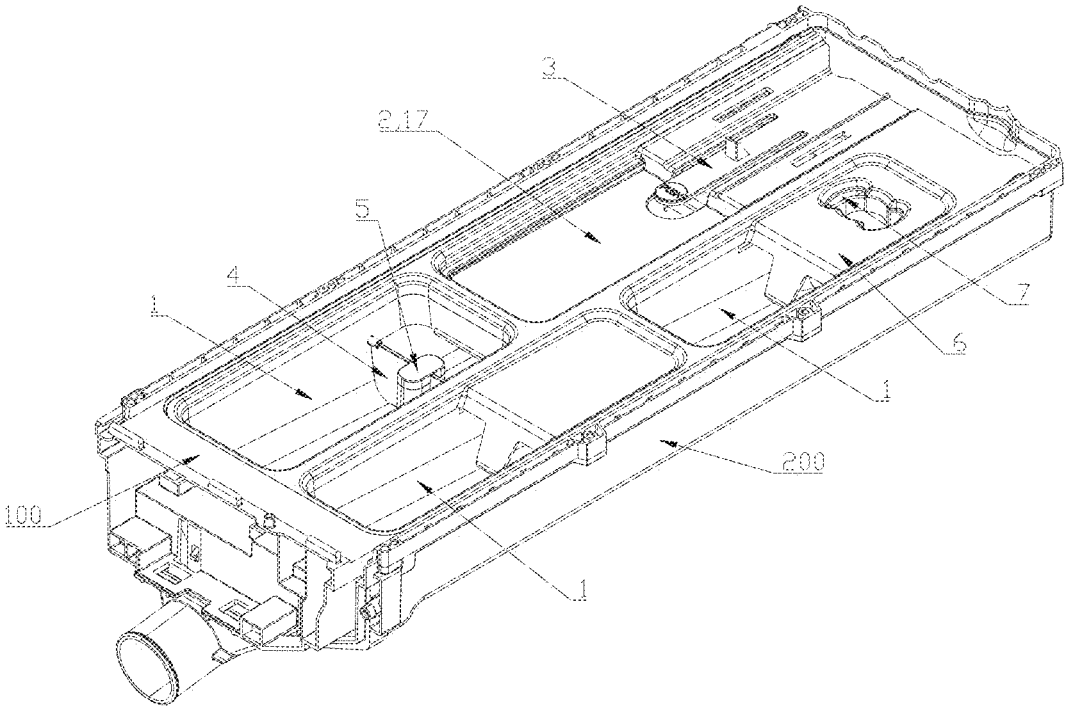
FIG. 1 is a structural schematic diagram of a washing feeding device in an embodiment of the present disclosure.
Figure 2:
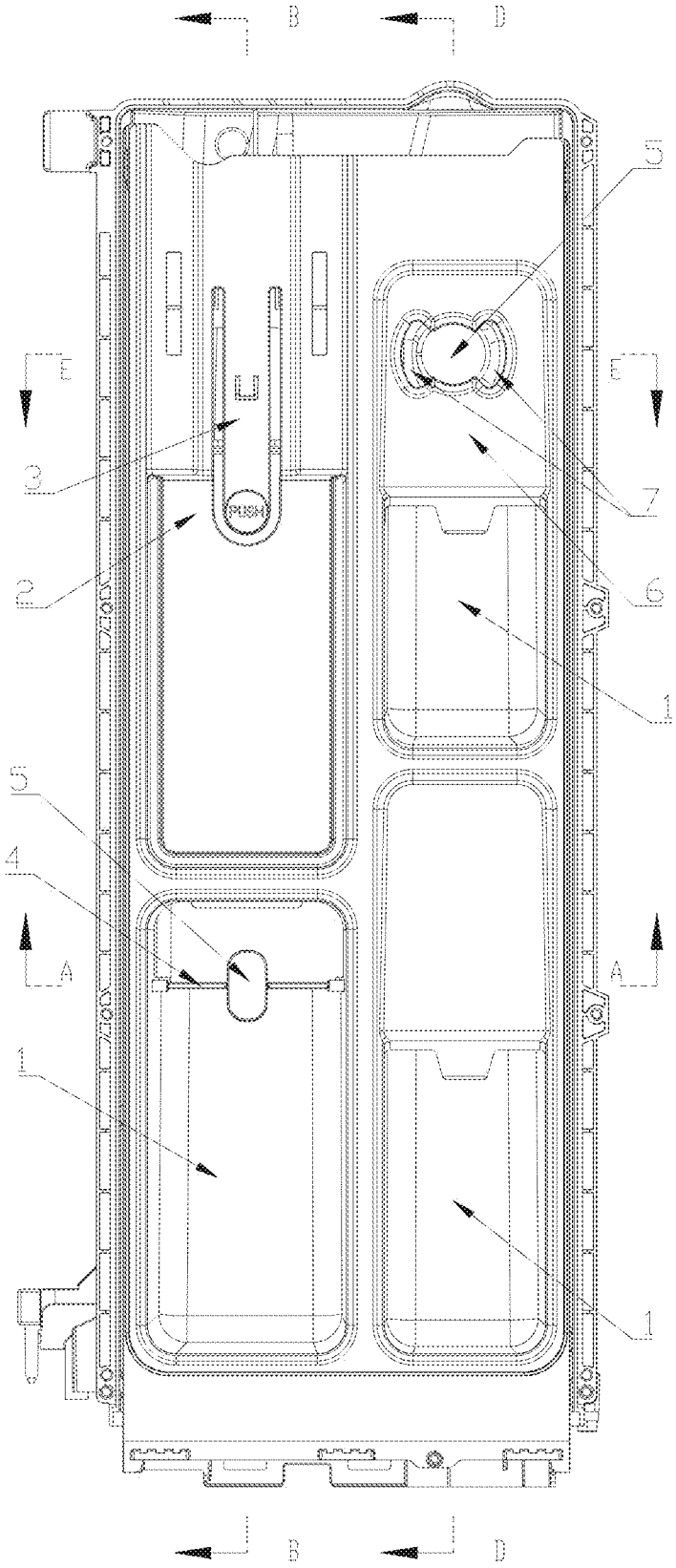
FIG. 2 is a top-view structural schematic diagram of a structure of a washing feeding device in an embodiment of the present disclosure.
Figure 3:
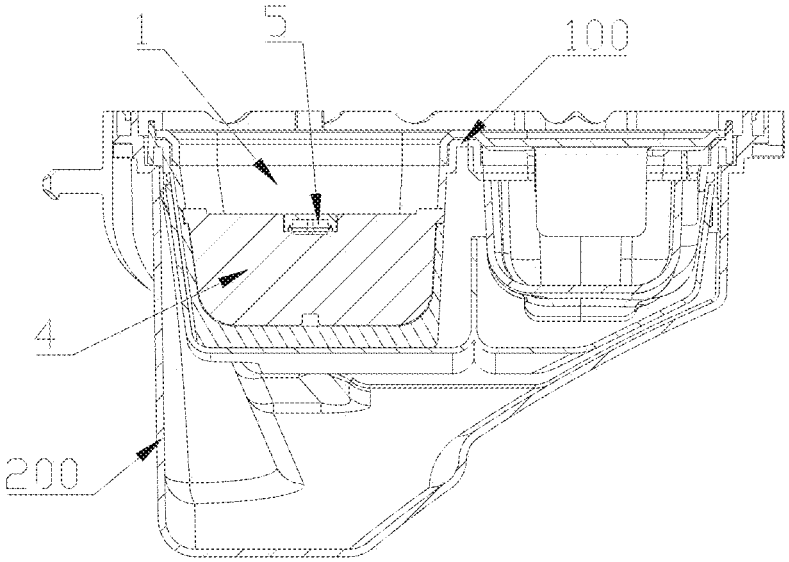
FIG. 3 is an A-A sectional view of FIG. 2 when a baffle board is at a vertically position in an embodiment of the present disclosure.
Figure 4:
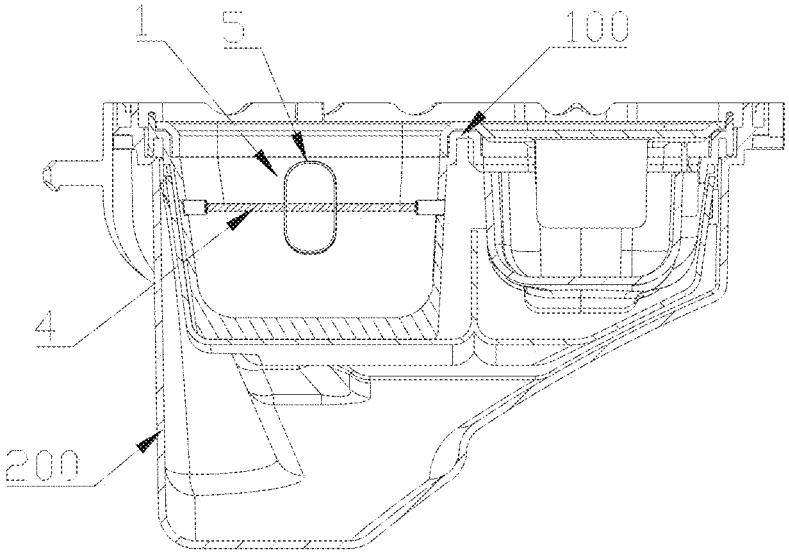
FIG. 4 is an A-A sectional view of FIG. 2 when a baffle board is at a horizontally position in an embodiment of the present disclosure.
Figure 5:
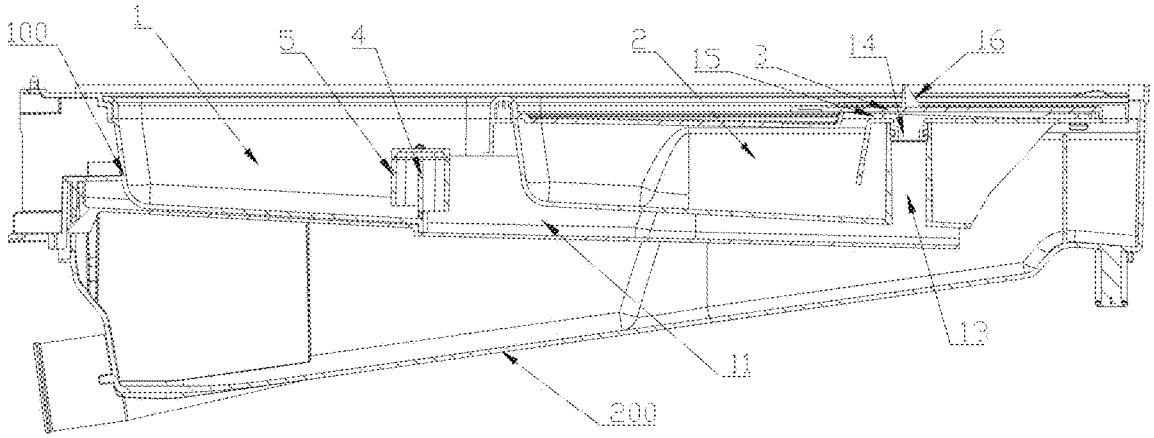
FIG. 5 is a B-B sectional view of FIG. 2 in an embodiment of the present disclosure.
Figure 6:
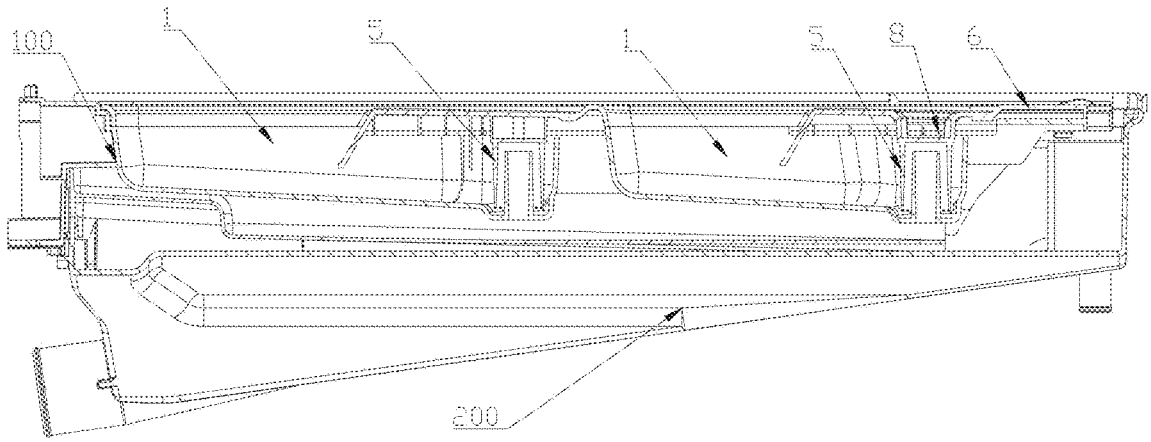
FIG. 6 is a D-D sectional view of FIG. 2 in an embodiment of the present disclosure.
Figure 7:
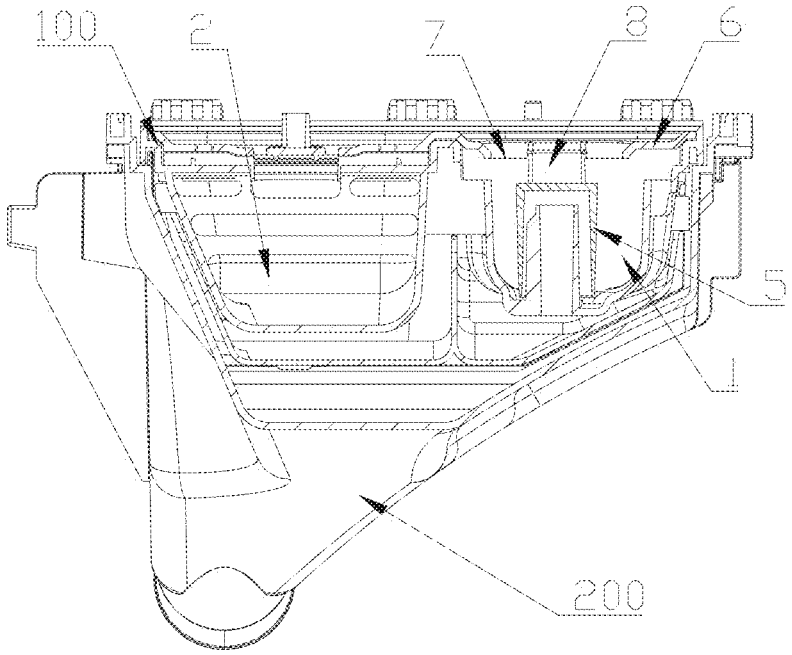
FIG. 7 is an E-E sectional view of FIG. 2 in an embodiment of the present disclosure.
Figure 8:
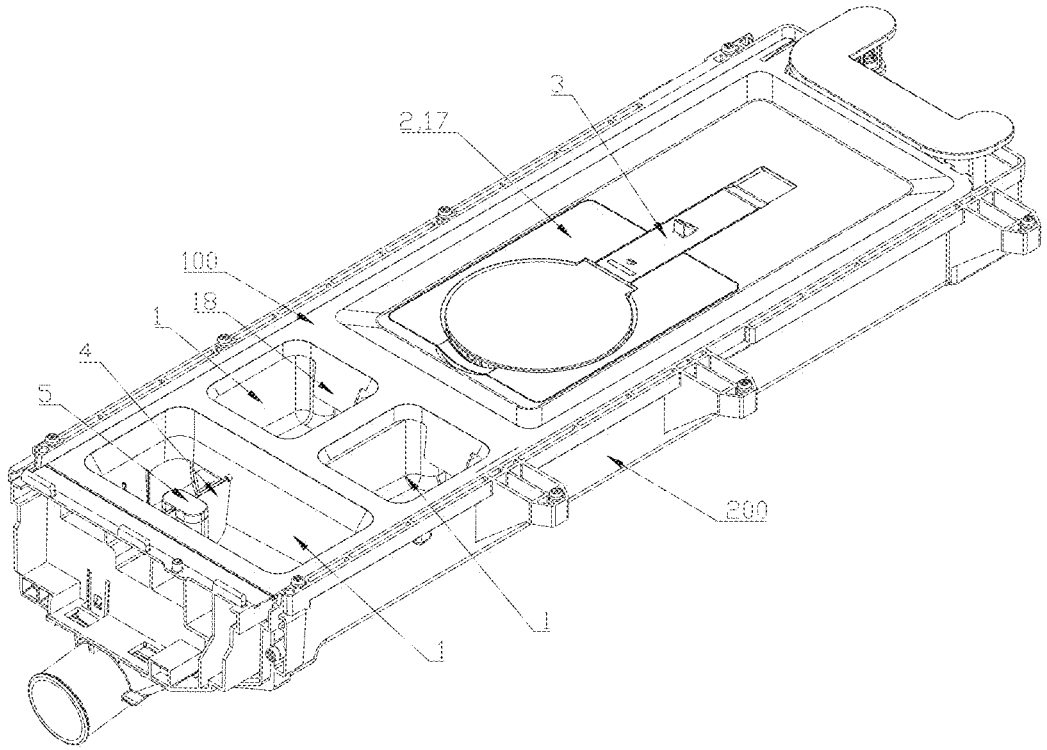
FIG. 8 is a structural schematic diagram of a washing feeding device in another embodiment of the present disclosure.
Figure 9:
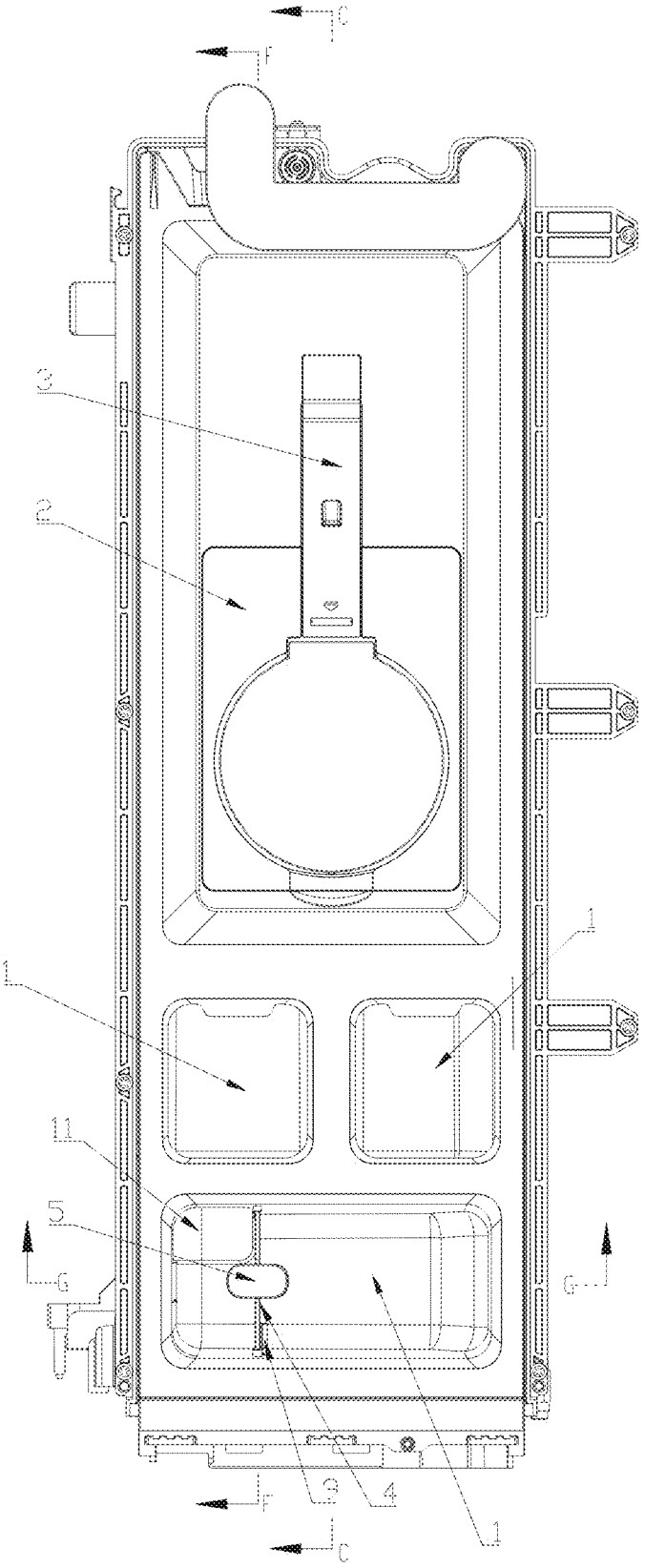
FIG. 9 is a top view of a washing feeding device when a baffle board is at a vertically position in another embodiment of the present disclosure.
Figure 10:
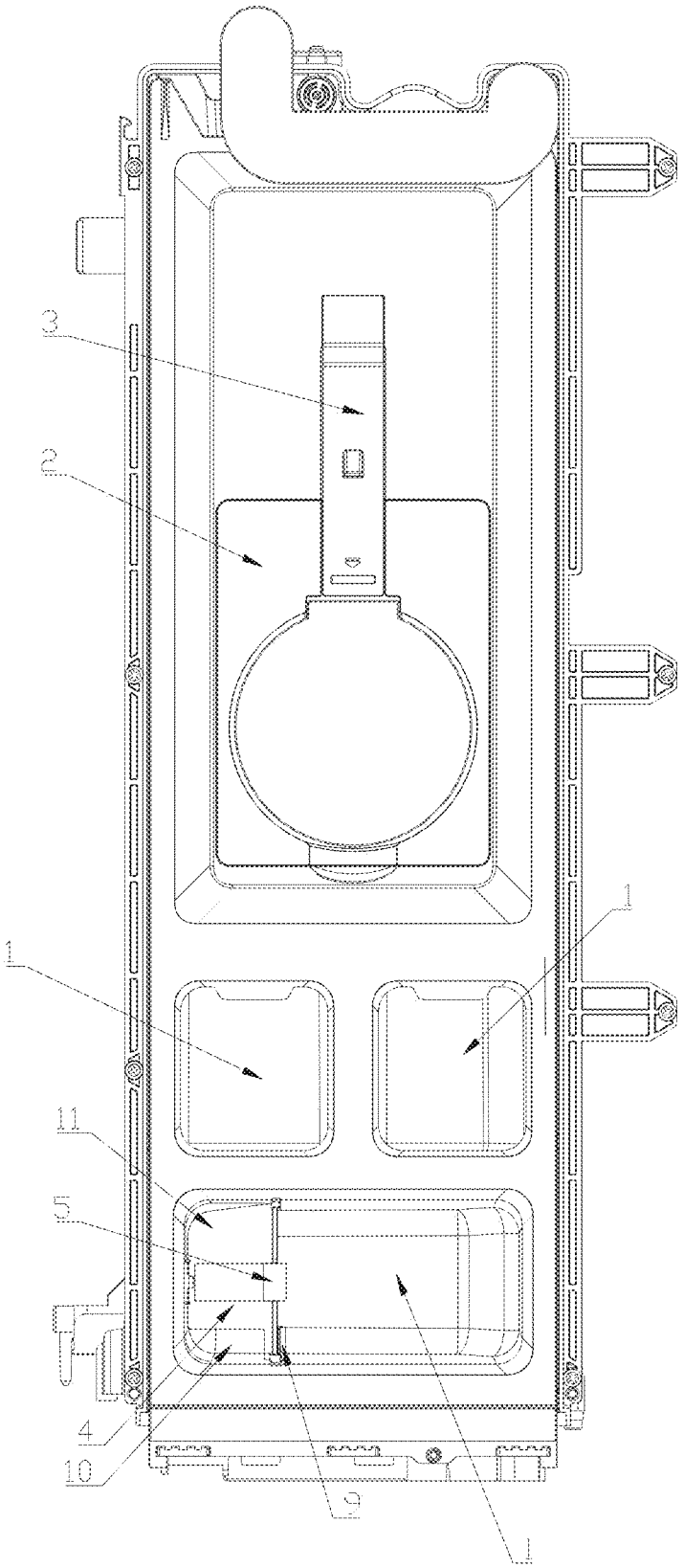
FIG. 10 is a top view of a washing feeding device when a baffle board is at a horizontally position in another embodiment of the present disclosure.
Figure 11:
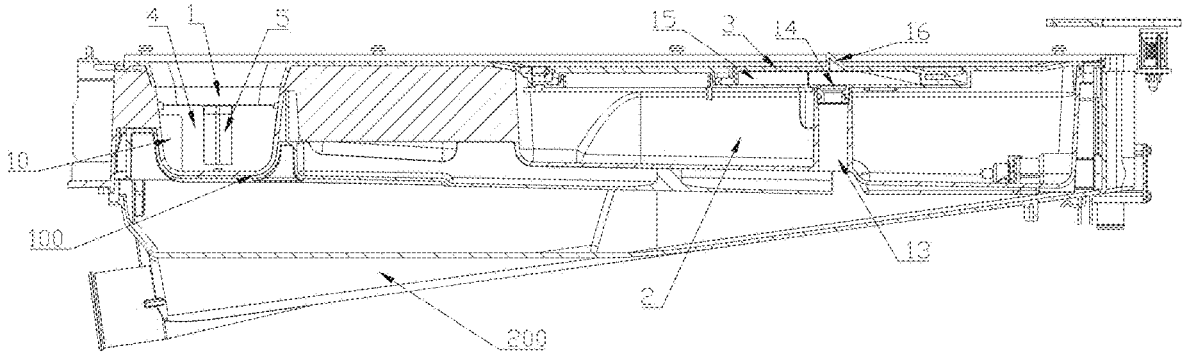
FIG. 11 is a C-C sectional view of FIG. 9 in an embodiment of the present disclosure.
Figure 12:
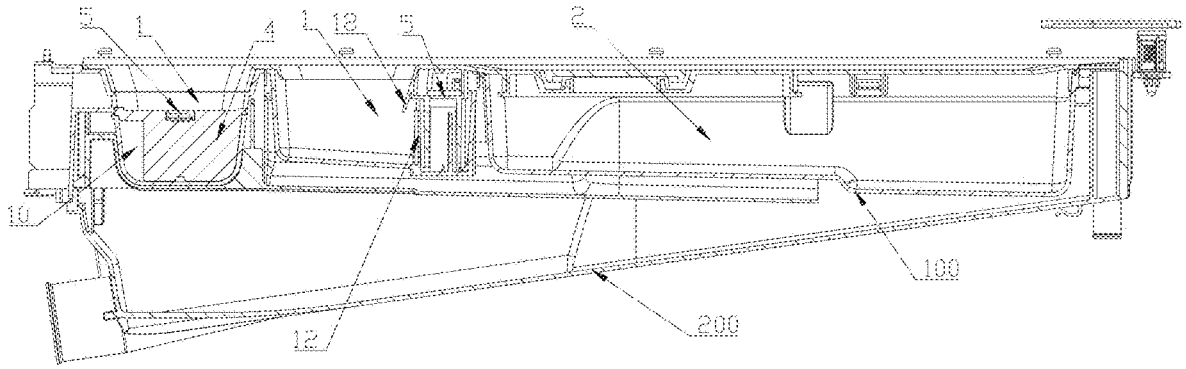
FIG. 12 is an F-F sectional view of FIG. 9 in an embodiment of the present disclosure.
Figure 13:
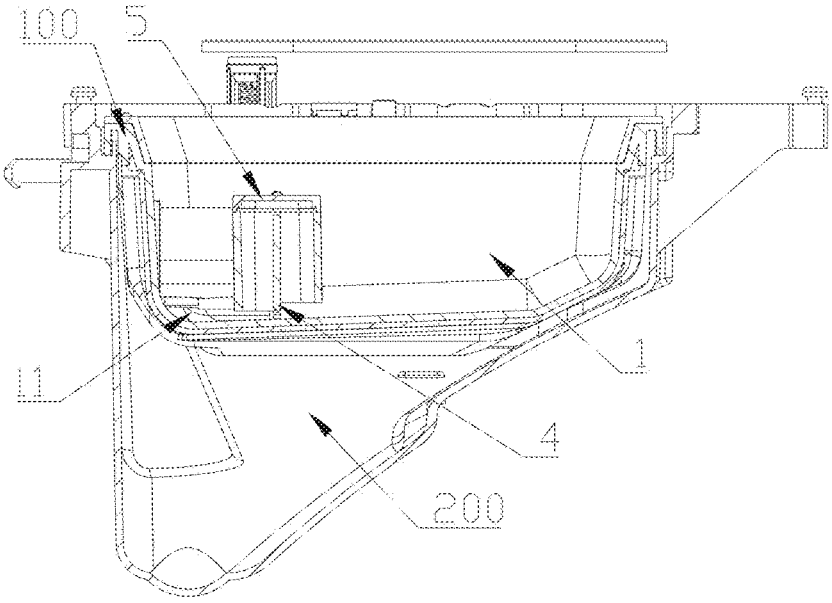
FIG. 13 is a G-G sectional view of FIG. 9 in an embodiment of the present disclosure.
Figure 14:
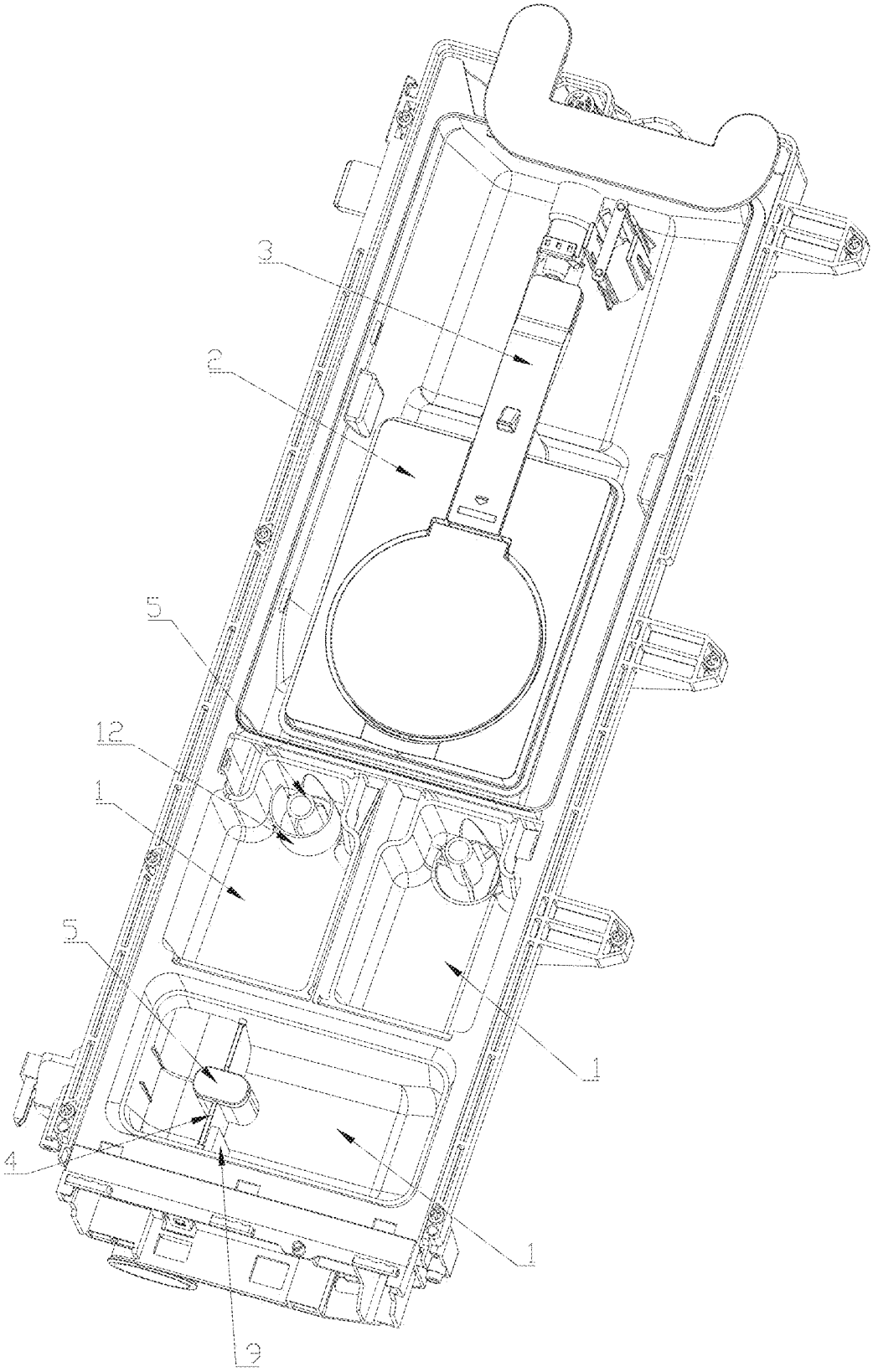
FIG. 14 is a structural schematic diagram of a washing feeding device with a cover plate removed in another embodiment of the present disclosure.

100—feeding box, 200—water box, 1—feeding chamber; 2—liquid storage chamber; 3—locking rod; 4—baffle board; 5—siphon; 6—cover plate; 7—hollow portion; 8—groove; 9—auxiliary baffle board; 10—gap portion; 11—water outlet; 12—blocking rib; 13—downpipe; 14—drain opening; 15—groove; 16—locking portion; 17—upper cover; 18—shielding rib; 19—lower cover, 191—diversion rib plate, 192—water inlet flow channel, 193—water inlet, 194—water outlet hole, 195—through hole; 20—inner rib plate; 21—outer rib plate; 22—water inlet pipe; 23—groove.

It should be noted that these accompanying drawings and written description are not aim to restrict scope of the conception of the present disclosure in any manner, but to describe the concept of the present disclosure for those skilled in the art with reference to specific embodiments.

DETAILED DESCRIPTION

In order to make the objective, the technical solution and advantages of the embodiments of the present disclosure clearer, the accompanying drawings in embodiments of the present disclosure will be incorporated below to describe the technical solutions in the embodiments of the present disclosure completely and clearly. The following embodiments are used for description of the present disclosure, yet without restricting the scope of the present disclosure.

In the description of the present disclosure, it should be noted that the orientation or position relationship indicated by terms such as "upper", "lower", "front", "rear", "left", "right", "vertical", "inner" and "outer" are orientation or position relationship indicated based on the accompanying drawings, the terms aim to facilitate description of the present disclosure and simplify the description, rather than to indicate or hint that the device or component indicated has a specific orientation, or is configured and operated at a specific orientation, and thus cannot be construed as restriction on the present disclosure.

In the description of the present disclosure, it should be noted that unless otherwise prescribed and defined clearly, terms such as "install", "communicate" and "connection" should be understood in a broad sense, for example, the connection may be a fixed connection and can also be a detachable connection or an integral connection, may be a mechanic connection and may also be an electrical connection, may be a direct connection and may also be an indirect connection through an intermediary. Those skilled in the art can understand the specific meanings of the above terms in the present disclosure depending on specific situations.

Embodiment I

As shown in FIGS. 1-14, an embodiment provides a washing feeding device comprising a water box 200. A feeding box 100 for feeding a detergent and/or washing powder is installed in the water box 200. Preferably, the feeding box 100 is correspondingly inserted into the water box 200 in a pulling manner. At least one feeding chamber 1 is arranged in the feeding box 100. A bottom of the feeding chamber 1 is provided with a water outlet 11 communicating with the water box 200. An inlet water flow of a washing machine flows into the feeding chamber 1, so that the detergent and/or the washing powder added to the feeding box 100 are/is flushed into the water box 200 by the water outlet 11 through an effect of the inlet water. A baffle board 4 for preventing the water from flowing to the water outlet 11 is installed in the feeding chamber 1. A siphon 5 for communicating two sides of baffle board is arranged on the baffle board 4. At an upstream side of the baffle board 4, the detergent fed to the water box 200 from the feeding box 100 and the inlet water are blocked by the baffle board 4 to be accumulated until reaching a liquid level for triggering a siphonic effect, then flow to a downstream side of the baffle board through the siphon 5, and finally flow out from the water box 200 through the water outlet.

By the above arrangement, the detergent added into the feeding chamber by the user can be blocked by the baffle board, thereby preventing the detergent which is not diluted by water from directly flowing into the water box, further realizing the purposes of improving detergent diluting efficiency and enlarging a detergent distribution range.

In the present embodiment, the feeding box 100 can be installed in the water box 200 in a horizontal pulling manner. The baffle board 4 is vertically arranged in middle of the feeding chamber 1. The baffle board 4 and the feeding box 100 are arranged vertically in a pulling direction, and the baffle board 4 covers any vertical cross section of the corresponding feeding chamber 1. The siphon 5 is a flow channel with inverted U-shape. Two ends of the flow channel are respectively located at two sides of the baffle board, and two parts of the feeding chamber 1 separated by the baffle board 4 are communicated with each other via the flow channel. The inlet water flows into the feeding chamber 1 at the upstream side of the baffle board 4, and is blocked by the baffle board 4 to be accumulated to be raised and dilute the detergent fed to the upstream side of the baffle board 4. When the liquid level of the inlet water in the feeding chamber 1 exceeds a corner of the flow channel with inverted U-shape, a siphonic effect is triggered, and further, the inlet water blocked by the baffle board 4 flows to the downstream side of the baffle board 4 through the inverted U-shape baffle board 4.

In the present embodiment, a height of the flow channel at a corner is not lower than a height of a top end of the baffle board 4, to avoid failure of triggering the siphonic effect after the height of washing water accumulated exceeds the baffle board 4, thereby ensuring smooth drain of the detergent via the siphon 5.

In the present embodiment, one end, at the upstream side of the baffle board 4, of the flow channel with inverted U-shape is a water inlet end. The other end, at the downstream side of the baffle board 4, of the flow channel with inverted U-shape is a water outlet end. An interval is formed between the water inlet end and the bottom wall of the feeding chamber for introducing the detergent and water to flow into the flow channel, and an interval is formed between the water outlet end and the bottom wall of the feeding chamber for introducing the detergent and water to flow out of the flow channel.

In the present embodiment, the height of the water inlet end of the flow channel with inverted U-shape is larger than that of the water outlet end, and the detergent and the water at the upstream side of the baffle board flow to the downstream side of the baffle board 4 under the effect of gravity after water in the water channel triggers the siphonic effect.

Preferably, in the embodiment, the bottom wall of the feeding chamber 1 is arranged obliquely downward gradually to the water outlet 11 along a direction vertical to the baffle board 4. The inlet water in the feeding chamber 1 spontaneously converges toward the direction of the water outlet 11 under the effect of gravity. Accumulated water in the upstream side of the baffle board 4 can converge smoothly to the water inlet end of the flow channel with inverted U-shape arranged at the baffle board 4, and water in the downstream side of the baffle board 4 can converge smoothly to the water outlet 11.

In the embodiment, the siphon 5 comprises a main body which is fixedly installed or integrated onto the baffle board 4 and with a tubular shape extending vertically and being hollow inside. A hollow portion of the main body is separated by the baffle board 4 into two mutually independent and vertically extending flow channels: respectively a water inlet flow channel and a water outlet flow channel. A top of the main body is buckled with an upper cover in a sealing manner. A lower side of the upper cover is provided with a groove sinking inward and tops of the water inlet flow channel and the water outlet flow channel are communicated by the groove.

The lower ends of the water inlet flow channel and the water outlet flow channel respectively form the water inlet end and the water outlet end.

In the embodiment, a top of the main body is provided with a circle of sealing rib protruding upward. Two circles of coordinating ribs protruding downward are arranged at a periphery of an upper cover. A groove is formed in middle of the coordinating rib at an inner circle. The two circles of coordinating ribs are separated by a certain interval to form an insertion slot, and the sealing rib is correspondingly inserted into the insertion slot to form sealed insertion between the upper cover and the main body. Preferably, a circle of sealing ring is installed in the insertion slot, and is clamped between the insertion slot and the main body. At least one wall of the sealing rib is attached to the insertion slot in a sealing manner, and at least one wall is attached to the main body in a sealing manner, thereby improving sealing performance at the insertion position to avoid water leakage and air leakage.

In the embodiment, the main body and the baffle board 4 are integrally formed; the upper cover is buckled to and fixedly connected to the top of the main body correspondingly.

In the embodiment, two sides, perpendicular to the baffle board 4, of the main body are planes. Two sides, parallel with the baffle board 4, of the main body are arc faces protruding toward an outer side of the main body. In the embodiment, joint places of the arc faces and the planes present smooth transition curved surfaces, to ensure smooth flowing of water in the feeding chamber 1.

In the embodiment, the baffle board 4 is pivoted and installed in the water box 200. The baffle board 4 is vertically arranged while the detergent is fed into the water box 200 by the feeding box 100 so as to block the detergent and the inlet water. The baffle board 4 is horizontally or obliquely arranged while washing powder is fed into the water box 200 by the feeding box 100 so as to facilitate flowing of the washing powder to the water outlet. By arranging the baffle board in a pivoted manner, a corresponding using state is adjusted when the feeding device respectively feeds liquid and solid washing additives, thereby ensuring smooth feeding of the additives.

In the embodiment, two ends of a top of the baffle board 4 are respectively provided with rotary shafts protruding outward. The two rotary shafts are arranged coaxially and penetrate respectively into side walls of the feeding chamber 1 at a corresponding side, so that the baffle board 4 is installed onto the feeding box 100 in an axial rotation manner. In the embodiment, the rotary shafts of the baffle board 4 are connected to a driving motor to drive the baffle board to rotate automatically under the effect of the driving motor, thereby switching the baffle board 4 between a vertical position and a horizontal position. Preferably, reset torsion springs are installed at the rotary shafts of the baffle board 4, and two ends of each reset torsion spring abut against the baffle board and the feeding box 100 respectively, and the tensioned torsion springs provide a reset acting force for the baffle board to drive the baffle board to reset to an initial state.

In the embodiment, when the baffle board 4 is at the vertical position, two sides of the baffle board 4 are correspondingly contacting with an inner side wall of the feeding chamber 1, a lower side of the baffle board 4 is correspondingly contacting with a bottom wall of the feeding chamber 1. Preferably, at least one limit portion protruding to an inside of the water box 200 is arranged on the inner side wall of the feeding chamber 1 for limiting and abutting the baffle board when the baffle board rotates to the vertical position. Preferably, in the embodiment, in order to maintain the baffle board immobile at the vertical position, inner side walls of a left side and a right side of the feeding chamber 1 are provided with first limit ribs extending vertically and protruding to the inside of the feeding chamber 1. The first limit ribs are arranged at vertical positions at lower sides of the rotary shafts of the baffle board correspondingly or at a one side away from the water outlet, and a water inlet side of the baffle board limits and abuts against the first limit rib when the baffle board 4 is in a vertical state.

In the embodiment, in order to avoid causing a too large opening angle when the baffle board 4 rotates to the horizontal position, an inner wall of a rear side of the feeding chamber 1 is provided with a horizontal second limit rib extending in a manner of protruding to the inside of the feeding chamber 1. A height of the second limit rib is equal to heights of the rotary shafts of the baffle board 4, so that a water outlet side of the baffle board 4 limits and abuts against the second limit rib when the baffle board is in a horizontal state.

Embodiment II

As shown in FIGS. 8-14, an embodiment provides a washing feeding device comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet 11 communicating with the water box 200, and an inlet water flow of a washing machine flows into the feeding chamber 1. The detergent and/or the washing powder added to the feeding box 100 flow/flows into the water box 200 by the water outlet through an effect of the inlet water. A baffle board 4 for preventing water from flowing to the water outlet 11 is installed in each feeding chamber 1 in an overturning manner. A gap portion 10 is formed on the baffle board. Another way of inlet water of the water box 200 flows to the gap portion 10 when the baffle board is pivoted. Water washes a bottom wall of the feeding chamber 1 below the baffle board when the baffle board is pivoted after passing through the baffle board 4 through the gap portion 10, and opening the baffle board.

By the above arrangement, the inlet water of the water box flows through the gap portion of the baffle board to wash the bottom wall of the feeding chamber blocked below the baffle board, thereby avoiding residue of the washing powder at the water outlet of the feeding chamber and realizing a purpose of preventing residue of washing powder at the water outlet of the feeding chamber shielded by the baffle board.

In the embodiment, an auxiliary baffle board 9 is arranged on the feeding chamber 1. The gap portion 10 is blocked by the auxiliary baffle board 9 when the baffle board 4 is reset, and the baffle board 4 and the auxiliary baffle board 9 jointly separate the feeding chamber 1 into two mutually independent portions. Thus, when the baffle board 4 with the gap portion is at the vertical position, the baffle board 4 and the auxiliary baffle board 9 jointly form a blocking portion covering a vertical cross section of the feeding chamber 1, and the detergent and the water added to the feeding chamber 1 are blocked by the blocking portion to be accumulated, thus achieving a purpose of diluting the detergent.

In the embodiment, the gap portion 10 on the baffle board 4 is arranged on a position, close to a side wall of the feeding chamber 1, of the baffle board, so that washing water flows from a corresponding side of the feeding chamber 1 and washes the bottom wall of the feeding chamber 1 below the baffle board after passing through the gap portion 10. Preferably, the water outlet of the feeding chamber 1 is formed in a side opposite to the gap portion 10 on the baffle board 4. By arranging the gap portion of the baffle board and the water outlet of the feeding chamber at two opposite sides of the feeding chamber, washing water flows from one side of the feeding chamber to the other opposite side after passing through the gap portion of the baffle board, thereby ensuring complete washing on the bottom wall of the feeding chamber below the baffle board by washing water.

In the embodiment, the water outlet 11 formed in the feeding chamber 1 is located in a groove formed in the bottom wall of the feeding chamber 1. The bottom wall of the feeding chamber 1 is arranged obliquely downward gradually toward the groove from the periphery. Water in the feeding chamber 1 converges to flow to the water outlet 11. Preferably, the water outlet 11 is located in bottom of the groove, and water converging to the groove is drained smoothly from the water outlet 11.

In the embodiment, the auxiliary baffle board 9 is vertically arranged in the feeding chamber 1. At least a portion of a periphery of the auxiliary baffle board 9 protrudes out of a periphery of the gap portion 10 when the baffle board is reset, and the baffle board 4 is limited to a vertical closing position via the auxiliary baffle board 9. Preferably, the auxiliary baffle board 9 is vertically installed inside the feeding chamber 1. One side and a bottom of the auxiliary baffle board 9 are respectively fixedly connected to an inner wall of the feeding chamber 1, and the auxiliary baffle board 9 and the feeding box 100 are integrally molded into one integrated piece.

In the embodiment, the baffle board 4 for preventing water from flowing to the water outlet 11 is installed in the feeding chamber 1. A siphon 5 is arranged on the baffle board for communicating two sides of the baffle board. At an upstream side of the baffle board 4, the detergent fed into the water box 200 from the feeding box 100 and the inlet water are blocked by the baffle board to be accumulated until reaching a liquid level for triggering a siphonic effect, then flow to a downstream side of the baffle board through the siphon 5, and finally flow out from the water box 200 through the water outlet 11.

By the above arrangement, the detergent added into the feeding chamber by the user can be blocked by the baffle board, thereby preventing the detergent which is not diluted by water from directly flowing into the water box, further realizing the purposes of improving detergent diluting efficiency and enlarging a detergent distribution range.

In the embodiment, the baffle board is pivoted and installed in the water box 200. The baffle board 4 is in vertical position, while the detergent is fed into the water box 200 by the feeding box 100 so as to block the detergent and the inlet water. The baffle board 4 is in horizontal or obliquely position, while washing powder is fed into the water box 200 by the feeding box 100 so as to facilitate flowing of the washing powder to the water outlet. By arrangement of the baffle board capable of pivoting, a corresponding using state is adjusted when the feeding device respectively feeds liquid and solid washing additives, thereby ensuring smooth feeding of the additives.

In the embodiment, two ends of a top of the baffle board 4 are respectively provided with rotary shafts protruding outwards. The two rotary shafts are arranged coaxially and penetrate respectively into side walls of the feeding chamber 1 at a corresponding side. The baffle board is installed on the feeding box 100 in an axial rotation manner. In the embodiment, the rotary shafts of the baffle board 4 are connected to a driving motor to drive the baffle board 4 to rotate automatically under an effect of the driving motor, thereby switching the baffle board 4 between a vertical position and a horizontal position. Preferably, the baffle board 4 is provided with reset torsion springs at a position where the rotating shaft is installed, two ends of the reset torsion springs are abutted against the baffle board and the feeding box 100 respectively, and the reset torsion springs provide an acting force for the baffle board to drive the baffle board 4 to rotate to a horizontal state when the reset torsion springs are tensioned.

In the embodiment, when the baffle board 4 is in vertical position, two sides of the baffle board 4 are correspondingly contacting with an inner side wall of the feeding chamber 1. A lower side of the baffle board 4 is correspondingly contacting with a bottom wall of the feeding chamber 1. Preferably, at least one limit portion protruding to an inside of the water box 200 is arranged on the inner side wall of the feeding chamber 1 for limiting and abutting the baffle board when the baffle board 4 rotates to the vertical position. Preferably, inner side walls on a left side and a right side of the feeding chamber 1 are provided with first limit ribs extending vertically and protruding to the inside of the feeding chamber 1. The first limit ribs are arranged at corresponding vertical positions at lower sides of the rotary shafts of the baffle board correspondingly or at one side away from the water outlet, and a water inlet side of the baffle board limits and abuts against the first limit rib when the baffle board is in a vertical state.

In the embodiment, in order to avoid a too large opening angle when the baffle board 4 rotates to the horizontal position, an inner wall of a rear side of the feeding chamber 1 is provided with a horizontal second limit rib extending in a manner of protruding to the inside of the feeding chamber 1, a height of the second limit rib is equal to height of the rotary shafts of the baffle board 4, and the water outlet side of the baffle board 4 limits and abuts against the second limit rib when the baffle board is in a horizontal state.

Embodiment III

As shown in FIGS. 1 to 14, an embodiment provides a washing feeding device, comprising a water box 200, wherein a feeding box 100 is installed in the water box 200 for feeding a detergent and/or washing powder. Preferably, the feeding box 100 is correspondingly inserted into the water box 200 in a pulling manner. A downpipe 13 is arranged inside the feeding box 100. The downpipe 13 is vertically penetrating through an upper side and a lower side of the feeding box 100. An upper end and a lower end of the downpipe 13 are respectively located at an upper side wall and a lower side wall of the feeding box 100, to guide residual water on a top surface of the feeding box 100 to a bottom of the water box 200 below the feeding box 100 through the downpipe 13.

By arranging the downpipe is arranged on the feeding box of the feeding device in a vertical penetration manner. Residual inlet water on the top surface of the feeding box flows to the bottom of the water box below the feeding box through the downpipe, thereby avoiding residue of water on the top surface of the feeding box, and further preventing the residual water from leaking to the outside of a washing machine when the user pulls the feeding box out.

In the embodiment, the feeding box 100 comprises a main body, and a hollow portion inside the main body forms a liquid storage chamber 2. A top of the liquid storage chamber 2 is provided with an opening. A top of the main body is provided with an upper cover 17 buckled to the opening. A drain opening 14 penetrating up and down is arranged on the upper cover 17, and is communicated with the downpipe 13.

In the embodiment, the downpipe 13 extending vertically is arranged inside the liquid storage chamber 2. A bottom opening of the downpipe 13 extends out from a bottom wall of the liquid storage chamber 2. A top of the downpipe 13 is contacting with the upper cover 17 in a sealing manner, and a top opening of the downpipe 13 is arranged coaxially with the drain opening 14. Preferably, a size of the top opening of the downpipe 13 is greater than a size of the drain opening 14; thereby making the top of the downpipe 13 abut against a lower side of the upper cover 17 in a sealing manner.

In the embodiment, the downpipe 13 is located in middle of the liquid storage chamber 2. A liquid outlet for the detergent to flow out is formed closely to a rear side of the liquid storage chamber 2 in a pulling-in direction of the feeding box 100, and a control valve is installed at the liquid outlet.

In the embodiment, the upper cover 17 is provided with a circle of flanging protruding downward at the drain opening 14. The flanging stretches to the inside of the downpipe 13. An outer peripheral wall of the flanging is attached to an inner wall of the downpipe 13 for contact. Preferably, at least one circle of sealing ring is installed at a contact surface of the flanging with the downpipe 13.

In the embodiment, the drain opening 14 is located at the lowest part of the upper cover. In order to improve efficiency of draining residual water on the top surface of the feeding box 100, a groove 15 sinking downward is formed on an upper side of the upper cover. The drain opening 14 is located in a bottom wall of the groove 15, thereby draining all residual water converging to the groove through the drain opening, and further avoiding a retaining area of residual water on the top surface of the feeding box 100 and collecting residual water all into the groove.

In the embodiment, a lower end outlet of the downpipe 13 is formed in middle of the feeding box 100. Preferably, when the feeding box 100 is located in a pull-out state, when a washing additive is added to the liquid storage chamber 2, the outlet of the downpipe 13 is still retained inside the water box 200, to prevent residual water drained along the downpipe from flowing out from the water box 200, thereby avoiding polluting the external ground of the washing machine.

In the embodiment, the top surface of the upper cover 17 is provided with the groove 15 sinking downward. An opening of the groove 15 is covered with a locking rod 3. One end of the locking rod 3 is connected to the upper cover 17 and another end of the locking rod 3 is arranged optionally, to make a movable end of the locking rod 3 generate elastic expansion in a vertical direction under the effect of an external force. An interval exists between a periphery of the locking rod 3 and an inner wall of the groove 15, and the drain opening 14 is formed in a bottom of the groove 15 below the locking rod 3. Further preferably, an optional end of the locking rod 3 or a part close to the optional end is provided with a protruding portion protruding upward.

In the embodiment, the locking rod 3 extends along a pulling direction of the feeding box 100. A locking portion 16 protruding upward is provided in a middle of the locking rod 3, and the drain opening 14 is arranged below the locking portion 16 vertically accordingly.

In the embodiment, in order to improve draining efficiency and reduce residual water on the top, a plurality of downpipes 13 can be arranged on the feeding box 100. The downpipes 13 are respectively arranged at different positions of the feeding box 100 to drain residual washing water at different areas on the upper cover 17 of the feeding box 100.

Embodiment IV

As shown in FIGS. 8-14, an embodiment provides a washing feeding device, comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet communicating with the water box 200. An inlet water flow of a washing machine flows into the feeding chamber 1, and the detergent and/or the washing powder added to the feeding box 100 flow/flows into the water box 200 through the water outlet by an effect of the inlet water. At least one feeding chamber 1 arranged on the feeding box 100 is used for feeding a liquid washing additive. A siphon column 5 is installed in the feeding chamber 1, and a center flow channel and a peripheral flow channel are arranged in the siphon column 5. The center flow channel and the peripheral flow channel are mutually independently and vertically extending. Top ends of the center flow channel and the peripheral flow channel are sealed via a siphon cover and communicate with each other. A bottom end of the center flow channel is communicated with the water box 200, and a bottom end of the peripheral flow channel is communicated with the feeding chamber 1. A blocking rib 12 arranged around the periphery of the siphon column is arranged in the feeding chamber 1, and the detergent and the inlet water in the feeding box 100 flow around the blocking rib 12 and into a space between the blocking rib 12 and the siphon column 5 after through the blocking rib 12.

By arranging a circle of blocking rib at the periphery of the siphon column, the siphon column and the feeding chamber are separated, to prevent the siphon column from triggering siphoning by mistake due to increase of the liquid level at the siphon column caused by surging liquid in a process of pulling the feeding box. Thereby it is realized the purpose of preventing "surging" on the siphon column to avoid triggering siphoning by mistake.

In the embodiment, a lower end of the blocking rib 12 is connected to a bottom wall of the feeding chamber 1 in a sealing manner to prevent the detergent in the feeding chamber 1 from directly flowing to an inlet of the siphon column in a bottom of the siphon column 5. Preferably, a top of the blocking rib 12 is higher than a maximum liquid level of the feeding chamber 1. Further preferably, a top of the blocking rib 12 is connected to a top surface of the feeding chamber 1 in a sealing manner.

In the embodiment, the blocking rib 12 at least covers a pulling-out side of the siphon column 5 toward the feeding box 100. An interior of the feeding chamber 1 is separated by the blocking rib 12 into front portion and rear portion, so that the detergent and inlet water at a front side of the siphon column 5 are blocked by the blocking rib 12, to avoid converging to the siphon column 5 and further preventing surging generated by liquid in the feeding chamber 1 from being flowed into the siphon column 5.

In the embodiment, the blocking rib 12 is a circle of arc rib arranged around the periphery of the siphon column 5. A gap for allowing the detergent to pass through is formed in the blocking rib 12. Preferably, the gap in the blocking rib 12, relative to the siphon column 5, is formed in an opposite side of a pull-out direction of the feeding box 100.

In the embodiment, the siphon column 5 is arranged in the feeding chamber 1 close to a rear side. Two ends of the blocking rib 12 with arc-shape respectively extend close to a rear side wall of the feeding chamber 1. Interval gaps are formed between two ends of the blocking rib 12 with arc-shape and the rear side wall of the feeding chamber respectively, and the interval gaps are used for allowing the detergent to pass through.

In the embodiment, the blocking rib 12 is covered by the periphery of the siphon cover, making the siphon cover and the blocking rib 12 overlap on a vertical projection face. A lower side of the siphon cover is apart from a top end of the blocking rib 12 to form a certain interval. The blocking rib 12 blocks the detergent and the inlet water so as to block and isolate surging inside the feeding chamber 1, and meanwhile, the detergent and the inlet water flow to the periphery of the siphon column 5 through the interval between the blocking rib 12 and the siphon cover.

In the embodiment, a pull-out side of the siphon cover toward the feeding box 100 is provided with a shielding rib 18 extending in a downward protruding manner. The shielding rib 18 and the blocking rib 12 are arranged in interval. The shielding rib 18, relative to the blocking rib, is arranged closely to a side, facing a side of the feeding box being pulled out, of the feeding box 100. A lower end of the shielding rib 18 is lower than a top end of the blocking rib 12. The detergent and water can flow through the interval between the shielding rib 18 and the blocking rib 12 to flow between the blocking rib 12 and the siphon column 5.

In the embodiment, a first sleeve extending vertically downward is arranged in middle of the siphon cover, and a second sleeve extending vertically upward is arranged on the bottom wall of the feeding chamber 1. The second sleeve is arranged inside the first sleeve. An interval gap is formed between the first sleeve and the bottom wall of the feeding chamber 1. The interval gap is formed between a top of the second sleeve and the siphon cover. The peripheral flow channel is formed by a space between the first sleeve and the second sleeve. The center flow channel is formed by an inside of the second sleeve. A bottom of the second sleeve is communicated with the water box 200.

In the embodiment, the bottom of the feeding chamber 1 is provided with a groove sinking downward. The siphon column 5 is arranged in the groove, and the blocking rib 12 is arranged at a peripheral edge of the groove. Preferably, the blocking rib 12 is located at the periphery of the groove. Further preferably, one side, toward the siphon column 5, of the blocking rib 12 is coplanar with an inner wall of the periphery of the groove.

In the embodiment, a plurality of feeding chambers 1 is arranged on the feeding box 100. The feeding chambers 1 are respectively used for feeding different types of washing additives. The siphon column 5 and the blocking rib 12 arranged around the periphery of the siphon column 5 are arranged inside at least one of the feeding chambers 1. The detergent in the feeding box 100 flows between the blocking rib 12 and the siphon column 5 after passing through the blocking rib 12.

Embodiment V

As shown in FIGS. 1 to 7, an embodiment provides a washing feeding device, comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet communicating with the water box 200. An inlet water flow of a washing machine flows into the feeding chamber 1, and the detergent or the washing powder added to the feeding box 100 flows into the water box 200 by the water outlet through an effect of the inlet water. At least one feeding chamber 1 arranged on the feeding box 100 is used for feeding a liquid washing additive. A part of opening of the feeding chamber 1 is covered with a cover plate 6, a siphon 5 located below the cover plate 6 is installed in the feeding chamber 1. A hollow portion 7 located at the periphery of the siphon 5 is arranged on the cover plate 6, and water on the cover plate 6 flows through the hollow portion 7 to the feeding chamber 1 below.

By arranging the hollow portion at the periphery of the siphon on the cover plate of the feeding chamber, inlet water for washing on a top surface of the feeding box flows into the feeding chamber through the hollow portion, thereby avoiding residue of the inlet water on the top surface of the feeding box. Meanwhile, water on the top surface of the feeding box flows into the feeding chamber through the hollow portion close to the siphon, so that the water can flow downward along an outer wall of the siphon to wash the outer wall surface of the siphon, thereby avoiding residue of the detergent on the outer wall of the siphon and preventing generation of water stain.

In the embodiment, a groove 8 sinking downward is formed in the cover plate 6. The groove 8 is correspondingly formed above the siphon 5. A bottom of the groove 8 is provided with the hollow portion 7 interlaced with the siphon 5. By forming the groove sinking downward on the cover plate, the inlet water on the top surface of the cover plate can be rapidly collected into the groove, thereby avoiding expansion of a retaining scope of residual water on the top surface of the feeding box.

In the embodiment, left side and right side of the siphon 5 are symmetrically arranged relative to a pulling direction of the feeding box 100, and respectively provided with the hollow portion 7. Water on the top surface of the feeding box 100 flows respectively through hollow portions 7 arranged at left side and right side of the siphon 5 to wash peripheries of the siphon 5 below the cover plate 6.

In the embodiment, the hollow portions 7 at the left side and right side of the siphon 5 are arc-shape. Inner peripheries of the hollow portions 7 with arc-shape are vertically parallel and level with an outer periphery of the siphon 5. And water flowing into the feeding chamber 1 from the inner peripheries of the hollow portions 7 flows along the outer wall of the siphon 5 into the feeding chamber 1 to directly wash the outer wall of the siphon 5.

In the embodiment, front side and rear side of the siphon 5 are respectively connected to the cover plate 6 through connecting ribs extending vertically. A top of the siphon 5 is formed a bottom of the groove 8, and the connecting ribs arranged front side and rear side of the siphon 5 is formed side walls of the groove 8. Walls of the groove 8 except the connecting ribs and the top of the siphon 5 are provided the hollow portions 7. The top of the siphon is the bottom of the groove, and water flowing into the groove from the top surface of the feeding box washes a top surface of the siphon, thereby effectively avoiding generation of water stain on the top surface of the siphon.

In the embodiment, an opening of the cover plate 6 forming a top opening of the groove 8 is provided with an arc-shape chamfered flanging bending downward, and an outer surface of the feeding box 100 is arranged circularly and smoothly to avoid the situation of scratching a user.

In the embodiment, the inlet water flow of the water box 200 flows to a place above the cover plate 6 and/or the hollow portions 7 and into the feeding chamber 1 through the hollow portions 7 to wash side walls of the siphon 5 and/or a bottom wall of the water box 200. By disposing the inlet water flow for washing the top surface of the feeding chamber on the water box of the feeding device, the inlet water flows into the feeding chamber through the hollow portions arranged on the top surface of the feeding chamber. After washing the top surface of the feeding chamber with washing water, the washing water is used again for washing the outer surface of the siphon below the hollow portion, thereby effectively avoiding generation of water stain on outer walls of the siphon.

Embodiment VI

Figure 15:
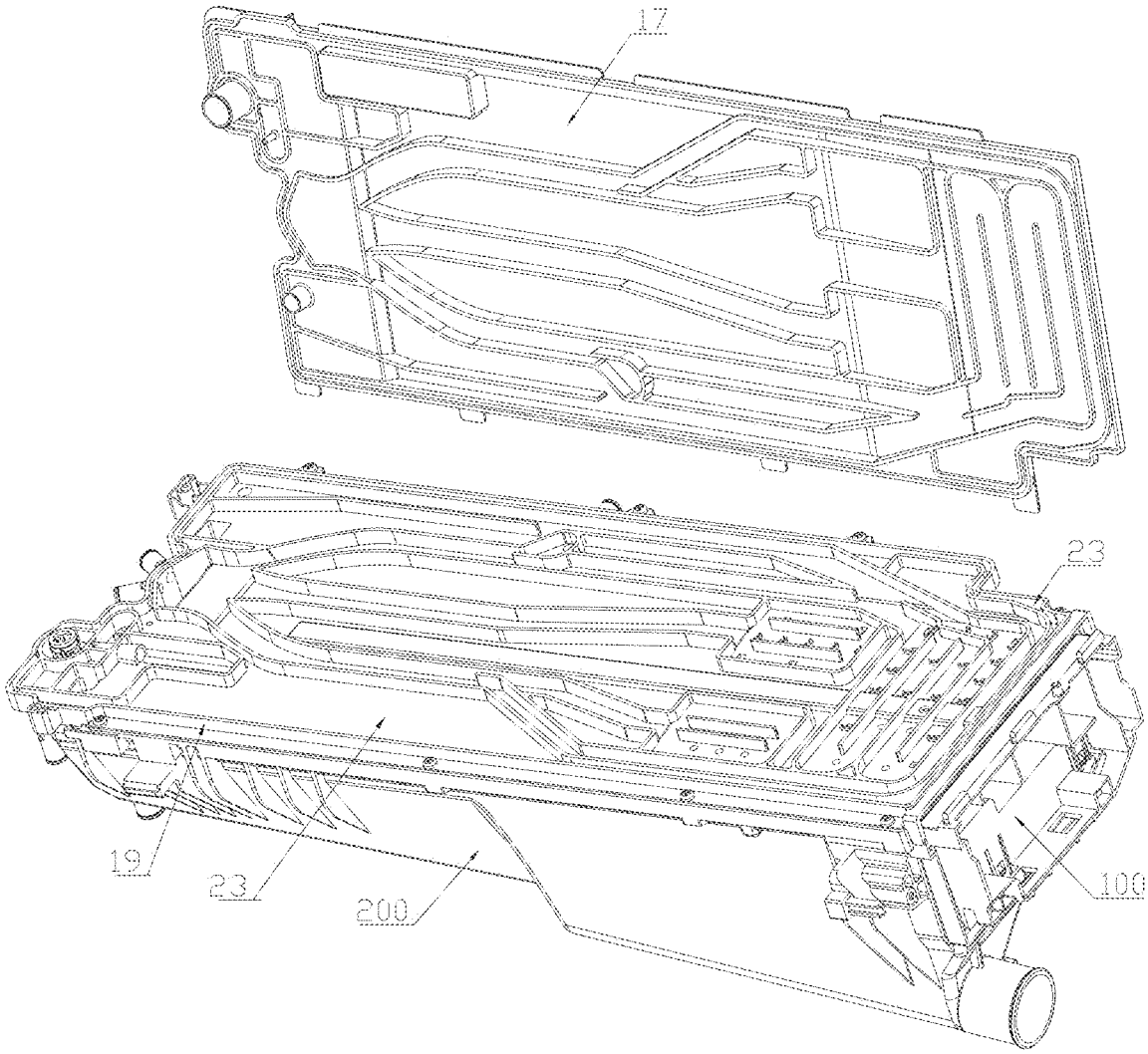
FIG. 15 is a structural exploded view of a washing feeding device in another embodiment of the present disclosure.
Figure 16:
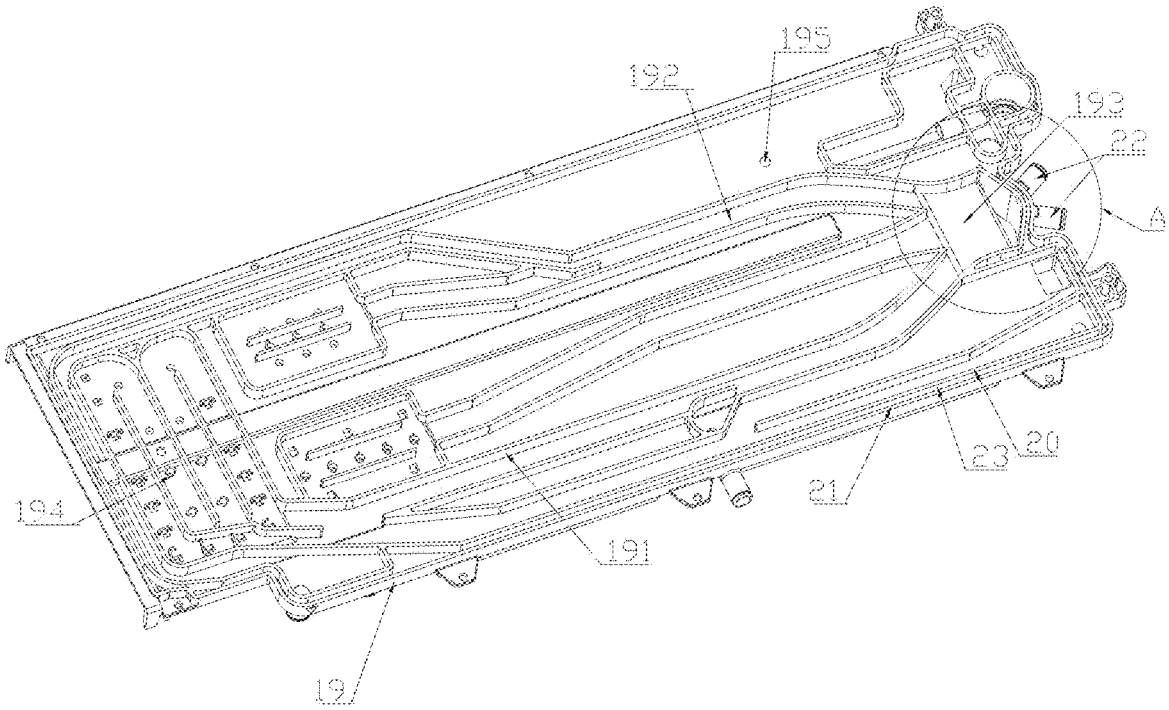
FIG. 16 is a structure diagram of a lower cover in another embodiment of the present disclosure.
Figure 17:
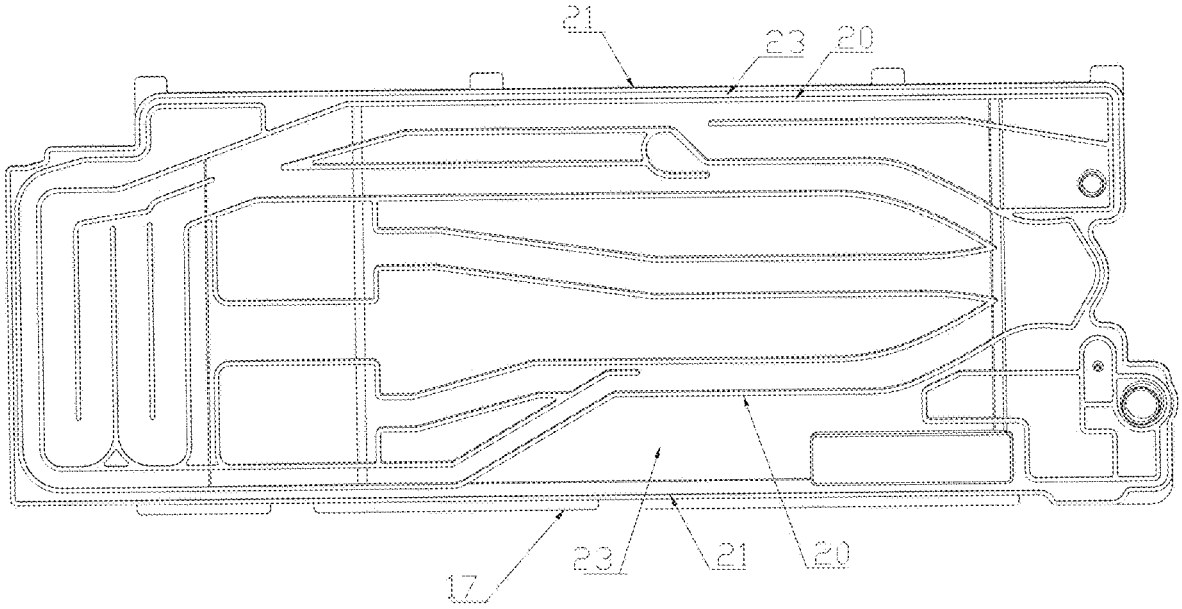
FIG. 17 is a structure diagram of an upper cover in another embodiment of the present disclosure.

As shown in FIGS. 15-17, an embodiment provides a washing feeding device, comprising a water box 200 and a feeding box 100 installed in the water box 200. A top of the water box 200 is provided with a cover plate. A water inlet flow channel 192 for injecting water into the feeding box 100 is arranged in a hollow chamber inside the cover plate. A periphery of the water inlet flow channel 192 is provided with an inner rib plate 20, a periphery of the cover plate is provided with an outer rib plate 21. An airtight chamber extending along a periphery of the cover plate is formed via the inner rib plate 20 and the outer rib plate 21 arranged with an interval, an inside of the airtight chamber is interconnected. A through hole 195 is arranged in the airtight chamber, and the airtight chamber is communicated with the exterior of the cover plate through the through hole 195.

In the embodiment, the inner rib plate 20 and the outer rib plate 21 respectively form a peripheral wall of the water inlet flow channel 192 and a peripheral wall of the cover plate. The cover plate comprises an upper cover 17 and a lower cover 19, the water inlet flow channels 192 are arranged on the upper cover 17 and/or the lower cover 19. The adjacent water inlet flow channels 192 are separated by diversion rib plates 191. The cover plate is formed by sealing and welding the inner rib plate 20 and the outer rib plate 21 and the diversion rib plates 191 arranged respectively at the upper cover 17 and the lower cover 19 correspondingly. In a transport and using process, collision may lead to crack of a welding part. Since water of the water inlet flow channels 192 are subjected to double-layer protection of the inner rib plate 20 and the outer rib plate 21. When the inner rib plate 20 is damaged, water flows to the airtight chamber and flows along the airtight chamber to the through hole 195, and then flows to a specified position through the through hole 195. In the present disclosure, the through hole 195 is communicated with the feeding box 100. After any position of the airtight chamber toward side walls of the water inlet flow channels 192 cracks, water of the water inlet flow channels 192 flows to the airtight chamber through the crack, and then flows to the through hole 195 along the interior of the airtight chamber, and then enters a place above the feeding box 100 and further flows into the water box 200.

By the above arrangement, the embodiment performs double-layer protection on the water inlet flow channels 192, thereby improving security and reliability. In a current washing feeding device, a layer of rib plate for welding is adopted. In a process of actually producing or transporting a washing machine, collision leads to crack of the welding part, causing water leakage. The present disclosure effectively avoids potential risk of water leakage.

Embodiment VII

As shown in FIGS. 15 to 18, in an embodiment, a washing feeding device is installed on a washing machine for automatically feeding a detergent solution into the washing machine. The washing feeding device comprises a feeding box 100 for holding a detergent and a cover plate for injecting water into the feeding box 100. A water inlet flow channel 192 is arranged on the cover plate. A periphery of the water inlet flow channel 192 is provided with an inner rib plate 20 and an outer rib plate 21 arranged in interval. An airtight chamber is form by the inner rib plate 20 and the outer rib plate 21, an inside of the airtight chamber is intercommunicated. The inner rib plate 20 and the outer rib plate 21 at two sides of the airtight chamber separate the water inlet flow channels 192 from the exterior.

In the embodiment, the cover plate comprises a lower cover 19 and an upper cover 17 mutually buckled. The upper cover 17 and the lower cover 19 are welded and fixed. The peripheries of the lower cover 19 and the upper cover 17 are provided the inner rib plates 20 and the outer rib plates 21 respectively. Grooves 23 with circle shape are formed between the inner rib plates 20 and the outer rib plates 21, the grooves 23 are provided with openings. The groove 23 of the lower plate 19 and the groove 23 of the upper cover 17 are matched oppositely to close the openings, thereby forming the airtight chamber. Alternatively, the inner rib plate 20 and the outer rib plate 21 are arranged on the lower cover 19. One side, buckled to the lower cover 19, of the upper cover 17 is a plane, one side of the inner rib plate 20 and the outer rib plate 21 toward the upper cover 17 is correspondingly fixed onto a surface of the upper cover 17. A space between the inner rib plate 20, the outer rib plate 21, the upper cover 17 and the lower cover 19 forms the airtight chamber.

In the embodiment, the outer rib plates 21 extend along a peripheral outline of the lower cover 19 and/or the upper cover 17, in a direction that is same with the peripheral outline of the lower cover 19 and/or the upper cover 17 in shape. The inner rib plates 20 extend along the peripheries of the water inlet flow channels 192, or the inner rib plates 20 and the outer rib plates 21 are arranged in parallel.

In the embodiment, the outer rib plate 21 of the lower cover 19 has the same shape as the outer rib plate 21 of the upper cover 17. The inner rib plate 20 of the lower cover 19 has the same shape as the inner rib plate 20 of the upper cover 17. The outer rib plate 21 of the lower cover 19 is correspondingly welded with the outer rib plate 21 of the upper cover 17 in a sealing manner. The inner rib plate 20 of the lower cover 19 is correspondingly welded with the inner rib plate 20 of the upper cover 17 in a sealing manner. The lower cover 19 and/or the upper cover 17 are/is provided with at least one water inlet flow channel 192 for guiding water flow. The water inlet flow channels 192 are respectively corresponding to areas of the feeding box 100 where different detergents are placed. The lower cover 19 is detachably fixed to a top of the water box 200. The feeding box 100 can be pulled inside the water box 200 and located below the cover plate. A water outlet hole 194 for injecting water into the feeding box 100 is formed in each water inlet flow channel 192 on the lower cover 19. The water outlet hole 194 injects a water-soluble detergent to the feeding box 100 and transfers the detergent into the washing machine. The adjacent water inlet flow channels 192 can be separated by single-layer diversion rib plates 191. Or, the adjacent water inlet flow channels 192 are separated by two-layer diversion rib plates 191. The two-layers diversion rib plates 191 are connected with interval in a sealing manner to form a chamber in which a through hole (not shown) communicating with the water box is formed. The heights of the diversion rib plates 191 are equal to the heights of the inner rib plates 20. The outer rib plates 21 protruding out from the lower cover 19 and/or the upper cover 17 toward the upper cover 17 and/or the lower cover 19. The inner rib plates 20 and the outer rib plates 21 of the upper cover 17 and the lower cover 19 are correspondingly welded with and fixed to the diversion rib plates 191.

Figure 18:
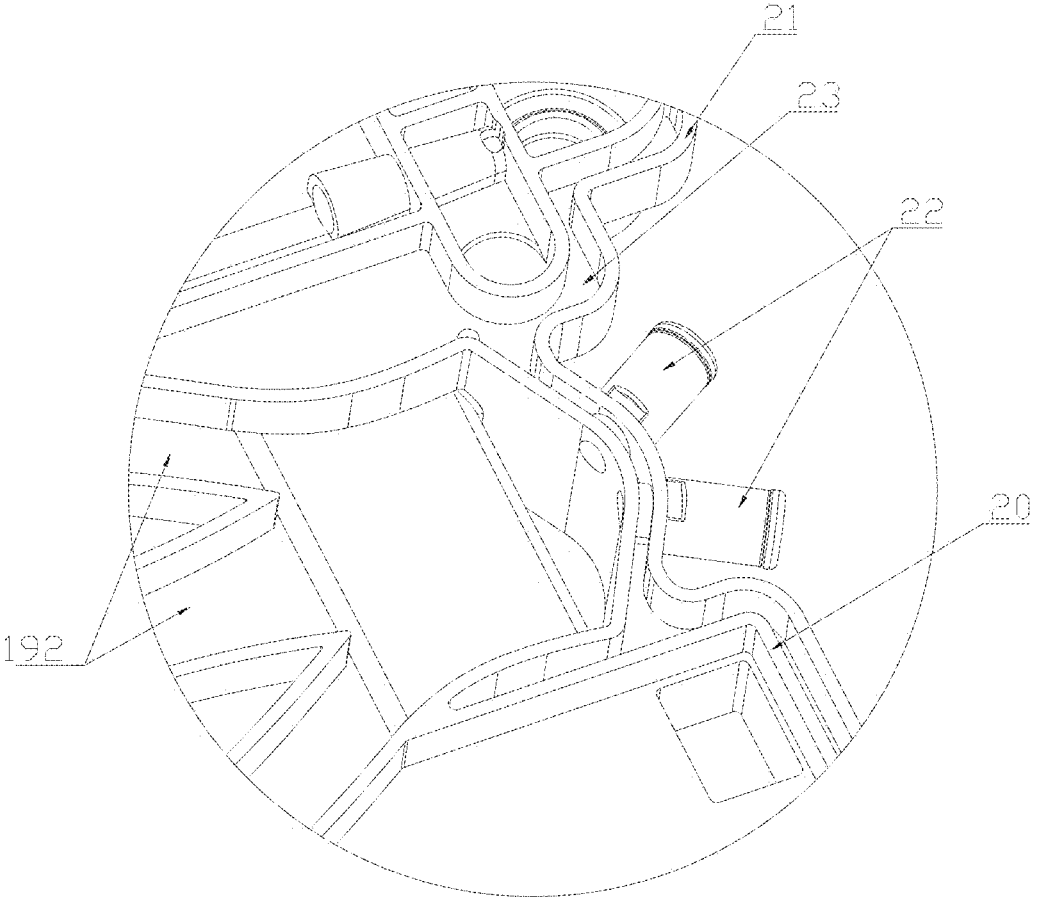
FIG. 18 is an enlargement diagram of an upper cover in another embodiment of the present disclosure.

In the embodiment, as shown in FIGS. 16 and 18, a water inlet pipe 22 is arranged on the cover plate. One end of the water inlet pipe 22 is connected to an external water supply system. Another end of the water inlet pipe 22 penetrates through the airtight chamber to be communicated with a water inlet 193 of each water inlet flow channels 192. Preferably, two water inlet pipes 122 which can respectively inject cold water and hot water into a washing box are arranged on the cover plate.

In the embodiment, the lower cover 19 is installed on the feeding box 100. At least one through hole 195 is formed in the groove 23 of the lower cover 19. One end of the through hole 195 is communicated with the airtight chamber. Another end of the through hole 195 is communicated with the interior of the water box 200. The inner rib plates 20 and the outer rib plates 21 of the upper cover 17 and the lower cover 19 are welded together through a device. After welding is completed, temperature of air in the airtight chamber gradually lowers, and negative pressure is generated in the airtight chamber, thereby causing deformation of the cover plate under the effect of air pressure and even risk of crack of the upper cover 17 and the lower cover 19. The through hole 195 formed in a position of the lower cover 19 corresponding to the airtight chamber can balance air pressure inside and outside and lower the risk of crack of the welding position of the upper cover 17 and the lower cover 19. In a process of using the washing feeding device, crack of the inner rib plate 20 at periphery of each water inlet flow channel 192 causes water leakage. Water of the water inlet flow channels 192 flows into the airtight chamber, and then water can flow to the interior of the water box 200 through the through hole 195. Since the inside of the airtight chamber is an entire communicating area, water leaking from any position of the inner rib plates 20 can flow into the feeding box 100 through the through hole 195, thereby avoiding potential risk of water leakage. After the inner rib plates 20 and the outer rib plates 21 of the upper cover 17 and the lower cover 19 are welded, pressure test can also be performed on the airtight chamber through the through hole 195 to detect whether there is a crack at the welding position.

In the embodiment, a plurality of mounting plates is arranged at the periphery of the lower cover 19, and mounting holes are formed in the mounting plates. Threaded holes opposite to the mounting plates are formed in the water box 200. The lower cover 19 is detachably installed on the top of the water box 200. A holding chamber is formed between the water box 200 and the cover plate, and an opening is formed in one side of the holding chamber. Two mutually parallel sliding rails are arranged on a side wall of the holding chamber. The feeding box 100 is pulled in and out from the opening of the holding chamber along extending directions of the sliding rails.

The above are merely preferred embodiments of the present disclosure, rather than restricting the present disclosure in any form. Although the preferred embodiments of the present disclosure are disclosed above, they are not used to restrict the present disclosure. Based on the technical content described above, changes or modifications made by any person skilled in the art without departing from the scope of the technical solution of the present disclosure are equivalently changed equivalent embodiments. For any content without departing from the technical solution of the present disclosure, any simple change, equivalent change and modification made to the above embodiments according to the technical substance of the present disclosure belong to the scope of the solution of the present disclosure.

The invention claimed is:

1. A detergent feeding device, comprising a water box and a feeding box installed in the water box, wherein a top of the water box is provided with a cover plate, a water inlet flow channel for injecting water into the feeding box is arranged in a hollow chamber inside the cover plate, a periphery of the water inlet flow channel is provided with an airtight chamber extending along a periphery of the cover plate, and the airtight chamber separates the water inlet flow channel from an exterior of the cover plate.

2. The detergent feeding device according to claim 1, wherein the cover plate comprises a lower cover and an upper cover buckled with each other, a groove is provided on a periphery of the lower cover, a groove is provided on a periphery of the upper cover, an opening of the groove of the lower cover and an opening of the groove of the upper cover are arranged oppositely, and the groove of the lower cover and the groove of the upper cover are matched with each other to close the opening of the groove of the lower cover and the opening of the groove of the upper cover and form the airtight chamber; or the cover plate comprises a lower cover and an upper cover buckled with each other, a groove with an opening is provided on a periphery of the lower cover, and one side, attached with the lower cover, of the upper cover is a plane, and a side wall, toward the upper cover, of the groove is attached onto a surface of the upper cover to close the opening of the groove and form the airtight chamber.

3. The detergent feeding device according to claim 2, wherein an inner rib plate and an outer rib plate are arranged in intervals on the lower cover and/or the upper cover, the groove of the lower cover or the groove of the upper cover is formed between the inner rib plate and the outer rib plate, and the outer rib plate extends along the periphery of the lower cover and/or the periphery of the upper cover, and the inner rib plate extends along the periphery of the water inlet flow channel; or the inner rib plate and the outer rib are arranged in parallel.

4. The detergent feeding device according to claim 3, wherein a shape of the outer rib plate of the lower cover is the same as a shape of the outer rib plate of the upper cover, a shape of the inner rib plate of the lower cover is the same as a shape of the inner rib plate of the upper cover, and the outer rib plate of the lower cover and the outer rib plate of the upper cover are correspondingly welded in a sealing manner, and the inner rib plate of the lower cover and the inner rib plate of the upper cover are correspondingly welded in a sealing manner.

5. The detergent feeding device according to claim 2, wherein the lower cover is detachably installed on the top of the water box, at least one through hole is formed in the groove of the lower cover, one end of the through hole is communicated with the airtight chamber and the other end of the through hole is communicated with the water box.

6. The detergent feeding device according to claim 2, wherein water inlet flow channels for guiding water flow are arranged on the lower cover and/or the upper cover of the cover plate, the water inlet flow channels are separated from the exterior via the inner rib plate and the outer rib plate, adjacent water inlet flow channels are separated by a diversion rib plate with two layers sealed at an interval, a height of the diversion rib plate is equal to a height of the inner rib plate or the outer rib plate protruding out of the lower cover and/or the upper cover to the upper cover and/or the lower cover.

7. The detergent feeding device according to claim 6, wherein a water inlet pipe is arranged on the lower cover, and passes through the airtight chamber to be communicated with a water inlet of the water inlet flow channel, and a water outlet hole is formed in the water inlet flow channel, and communicated with the feeding box.

8. A washing machine, comprising the detergent feeding device of claim 1.

* * * * *